US009470062B2

(12) United States Patent
Stolboushkin

(10) Patent No.: US 9,470,062 B2
(45) Date of Patent: Oct. 18, 2016

(54) APPARATUS AND METHOD FOR CONTROLLING MULTIPLE DOWNHOLE DEVICES

(71) Applicant: Baker Hughes Incorporated, Houston, TX (US)

(72) Inventor: Eugene Stolboushkin, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 292 days.

(21) Appl. No.: 14/187,690

(22) Filed: Feb. 24, 2014

(65) Prior Publication Data

US 2015/0240593 A1 Aug. 27, 2015

(51) Int. Cl.

| | |
|---|---|
| ***E21B 34/06*** | (2006.01) |
| ***E21B 34/10*** | (2006.01) |
| ***E21B 21/10*** | (2006.01) |
| ***E21B 33/128*** | (2006.01) |
| ***E21B 23/00*** | (2006.01) |

(52) U.S. Cl.

CPC ..... *E21B 34/10* (2013.01); *E21B 21/103* (2013.01); *E21B 23/006* (2013.01); *E21B 33/128* (2013.01)

(58) Field of Classification Search

CPC ..... E21B 34/06; E21B 2034/002; E21B 2034/007; E21B 33/12; E21B 33/128; E21B 34/10; E21B 23/006; E21B 21/10; E21B 21/103

See application file for complete search history.

(56) References Cited

U.S. PATENT DOCUMENTS

| | | | | |
|---|---|---|---|---|
| 4,434,854 | A | 3/1984 | Vann et al. | |
| 4,633,952 | A | 1/1987 | Ringgenberg | |
| 6,907,936 | B2 * | 6/2005 | Fehr | E21B 33/124 166/185 |
| 2004/0007356 | A1 | 1/2004 | Myron | |
| 2009/0050335 | A1 | 2/2009 | Mandrou | |
| 2011/0120773 | A1 | 5/2011 | Hilliard | |
| 2012/0006553 | A1 | 1/2012 | Korkmaz | |

OTHER PUBLICATIONS

PCT International Search Report, mailed Jun. 3, 2015—PCT/US2015/017194.

* cited by examiner

*Primary Examiner* — Yong-Suk (Philip) Ro
(74) *Attorney, Agent, or Firm* — Bracewell LLP

(57) ABSTRACT

A downhole tool for use in a wellbore and that is attached to a perforating string that creates perforations in a portion of the wellbore. Where the downhole tool can selectively flow fluid from the perforating string to surface, or circulate flow from surface to an annular space between the tool and a wellbore wall. The tool includes pressure actuated valves that provide the flow diverting functionality. The valves are in cooperation with one another to prevent fluid from the portion of the wellbore having the perforations from flowing into the annular space. A pressure actuated selector assembly, which is made up of a piston and specially configured mandrels that are coaxially stacked, selectively moves separate mandrels in an axial direction for opening and closing the valves.

24 Claims, 40 Drawing Sheets

$38_1$
$38_2$
$38_3$
$38_4$
$38_5$
$39_1$
$39_2$
$39_3$
$39_4$
$39_5$
$41_1$
$41_2$
$41_3$
$41_4$
$41_5$
$40_1$
$40_2$
$40_3$
$40_4$
$40_5$
$40_6$
$40_7$
$40_8$
$40_9$
$40_{10}$
36
24
26
22
20
14
12
18
30
28
15
21
19
16
17
10

FIG. 7
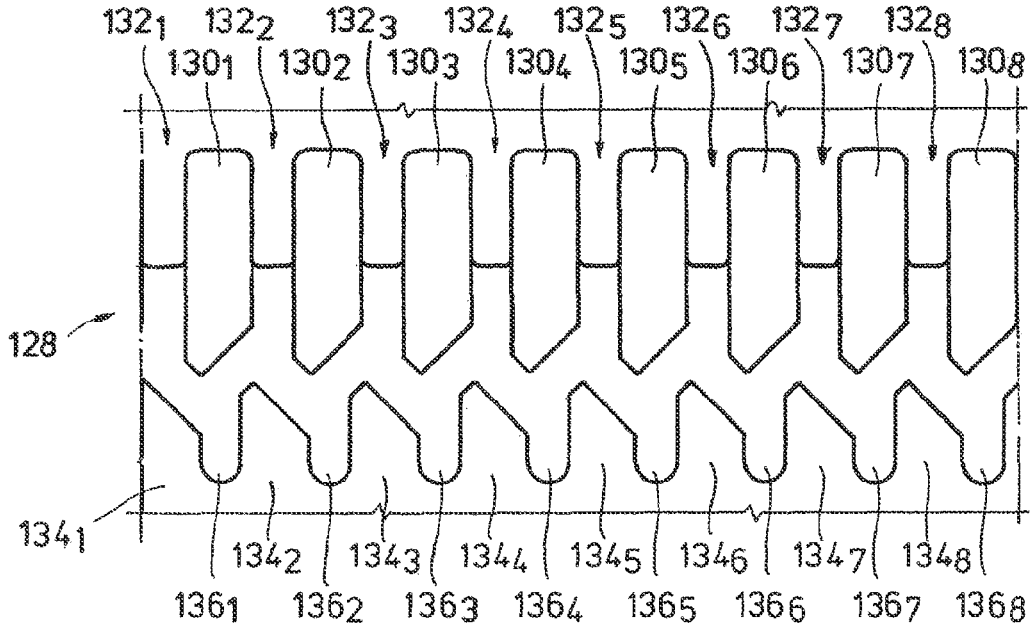
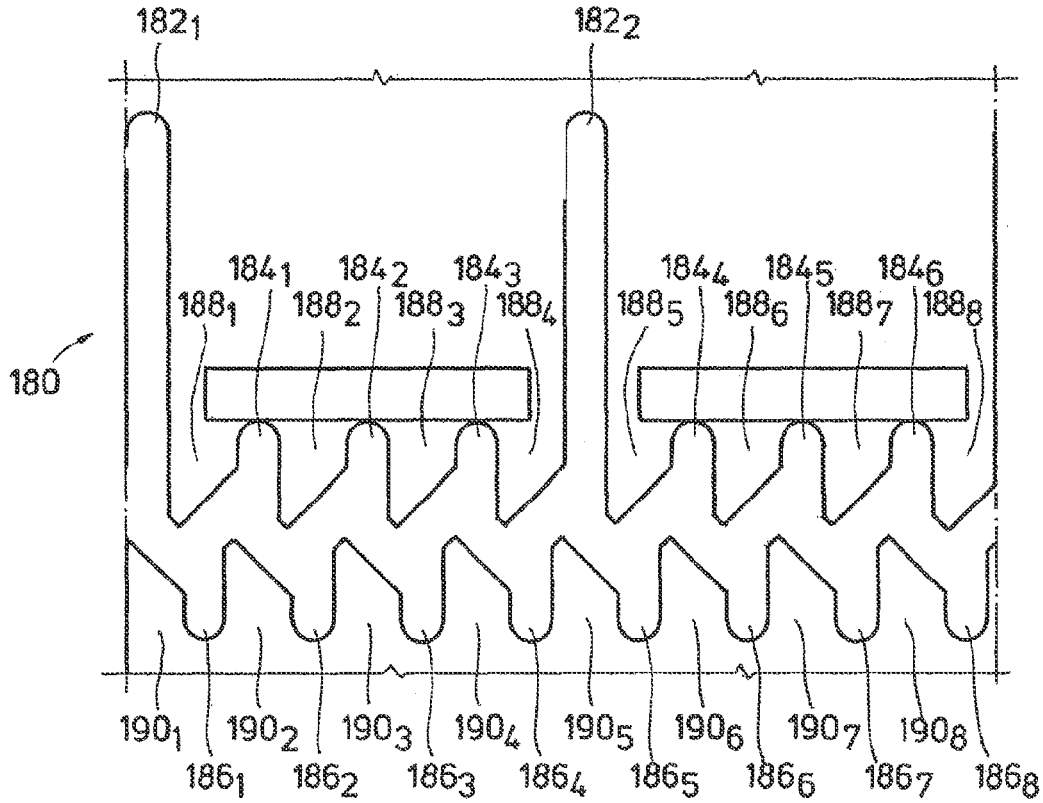
FIG. 9

APPARATUS AND METHOD FOR CONTROLLING MULTIPLE DOWNHOLE DEVICES

BACKGROUND OF THE INVENTION

1. Field of Invention

The present disclosure relates in general to a tool for regulating fluid flow through a perforating string. The present disclosure relates more specifically to a pressure activated tool for selectively directing a flow of connate fluid in the perforating string, and which includes indexing and switching assemblies.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

Perforating systems typically include one or more perforating guns strung together, these strings of guns can sometimes surpass a thousand feet of perforating length. Gun strings are generally deployed on wireline or slick line, and on tubing when the mass of the gun string exceeds the wireline/slick line handling capability. Some downhole configurations have the perforating string deployed downhole with a packer at a location around the string to define a pressure/flow barrier in the annulus between the string and borehole wall. Sometimes a need exists to selectively divert a flow of fluid within the perforating string to surface, or to circulate fluid within the annular space above the packer.

SUMMARY OF THE INVENTION

Described herein are examples of a downhole tool for use in a wellbore. In one example the downhole tool includes a housing, a packer on an outer surface of the housing that selectively extends radially outward into sealing contact with a wall of the wellbore to define a formation space below the packer and an annulus space above the packer. An annulus valve mandrel is also included in the housing along with an annulus valve coupled to the annulus valve mandrel and that is in an open configuration when the annulus valve mandrel is moved to an opened position and in a closed configuration when the annulus valve mandrel is moved to a closed position. Further included is a formation valve mandrel in the housing, a formation valve coupled to the formation valve mandrel and in an open configuration when the formation valve mandrel is moved to an opened position and in a closed configuration when the formation valve mandrel is moved to a closed position. A piston is axially moveable to different positions in the housing in response to a pressure ambient to an outer surface of the housing. A shifter assembly is in the housing that is rotatable and axially moveable with movement of the piston, and selectively and exclusively coupled with one of the formation valve mandrel or the annulus valve mandrel to selectively and exclusively open one of the formation valve or the annulus valve. The piston can be selectively moveable between a first, second, third, and fourth position. In an alternative, the formation valve is in the open position when an inner space in the housing is in communication with the formation space. Alternatively, when the annulus valve is in the open position an inner space in the housing is in communication with the annulus space. An example of the shifter assembly includes a selector member with an annular base mechanically coupled with the piston, and elongate arms that project axially from the base and are angular spaced away from one another about an axis of the tool, an annular slotted sleeve with downward facing axial slots on an outer surface of the slotted sleeve spaced angular apart about an axis of the slotted sleeve, and upward facing axial slots on an outer surface of the slotted sleeve spaced angular apart about an axis of the slotted sleeve, and wherein the upward and downward axial slots are connected by slots that extend between the upward and downward axial slots and define a path that circumscribes the slotted sleeve, and adjacent upward and downward slots are angularly offset from one another, a pin through one of the elongate arms that projects into the slots, so that when the piston is moved in opposing axial directions, the pin is directed from a one of the axial slots into an adjacent axial slot to rotate the selector member into selective engagement with one of the annulus valve mandrel or formation valve mandrel. The tool can further include a formation valve selector that has an annular collar coupled to the formation valve mandrel, and shoulders that project radially outward from the collar that are angularly spaced away from one another, and that are selectively in contact with the arms when the selector member is rotated into a designated angular orientation. This example of the tool and also include an annulus valve selector having an annular collar coupled to the formation valve mandrel, and shoulders that project radially outward from the collar that are angularly spaced away from one another, and that are selectively in contact with the arms when the selector member is rotated into a designated angular orientation. Fingers can be mounted to the formation valve selector collar that project axially into a one of the axial slots for rotationally coupling together the formation valve selector with the slotted sleeve, and fingers mounted to the annulus valve selector collar that project axially into another one of the axial slots for rotationally coupling together the annulus valve selector with the slotted sleeve. The formation valve selector and annulus valve selector can be arranged coaxially, and wherein the shoulders on the formation valve selector can be co-planar with the shoulders on the annulus valve selector when both the annulus valve and formation valve are closed. In an example, the formation valve selector and annulus valve selector both include legs that extend axially from the shoulders and in a direction away from the piston, the tool further comprising a stop ring member having an annular base ring with elongate legs that extend axially away from the base ring to form axial slots, wherein the axial slots are dimensioned to allow only a single one of the legs of the formation valve selector or the annulus valve selector, so that only a one of the formation valve or annulus valve is opened at a time. Alternatively, the shoulders on the formation valve selector are spaced axially away from the shoulders on the annulus valve selector when a one of the formation valve or the annulus valve is open. Optionally included is an annulus valve indexing assembly coupled with the annulus valve mandrel that includes an indexing collar having a continuous curved outer surface, axial slots on the outer surface that are spaced apart at different angles with respect to an axis of the tool, circumferential slots that connect the axial slots and form a slotted path that circumscribes the outer surface, and a pin coupled with the housing and that extends into the slotted path so that axial back and forth movement of the annulus valve mandrel causes the pin to move into adjacent axial slots and thereby rotate the mandrel, and wherein a one of the axial slots is formed so that when the pin the one of the axial slots, the annulus valve mandrel moves the annulus valve into the open configuration. A formation valve indexing assembly can be included that couples with the formation valve mandrel that is made up of an indexing collar having a continuous curved outer surface, axial slots on the outer surface that are spaced apart at different angles with respect to an axis of the tool, circumferential slots that connect the axial slots and form a slotted path that circumscribes the outer surface, and a pin coupled with the housing and that extends into the slotted path so that axial back and forth movement of the formation valve mandrel causes the pin to move into adjacent axial slots and thereby rotate the mandrel, and wherein a one of the axial slots is formed so that when the pin the one of the axial slots, the formation valve mandrel moves the formation valve into the open configuration.

Another example of a downhole tool for use in a wellbore includes a housing, an upper end in fluid communication with the Earth's surface, a lower end in fluid communication with fluid from a subterranean formation intersected by the wellbore, an annulus valve that is selectively opened and closed and that has a side in fluid communication with a space inside the housing and a side in fluid communication with an annular space between the housing and a wall of the wellbore, a formation valve having a side in communication with fluid from the subterranean formation and a side in fluid communication with the space inside the housing, a pressure actuated selector assembly connected to the annulus valve and the formation valve and that is selectively moved to a recirculating position that actuates the annulus valve into an open configuration while maintaining the formation valve in a closed configuration, and that is selectively moved to a venting position that actuates the formation valve into an open configuration while maintaining the annulus valve in a closed configuration. This example of the tool can further include a piston in pressure communication with an ambient space adjacent an outer surface of the housing. An optional annulus valve mandrel connects the annulus valve with the selector assembly, and a formation valve mandrel connects the formation valve with the selector assembly. The selector assembly can further have a selector member that selectively rotates into interfering contact with an annulus valve selector that is mounted on the annulus valve mandrel, wherein the selector member has a collar with elongate arms spaced at angular locations on the collar and projecting axially away from the collar. In an alternative, the annulus valve selector has an annular body with shoulders that project radially outward from the body and which are contacted by ends of the arms opposite the collar when the selector member is rotated into interfering contact with the annulus valve selector. The selector assembly may further include a selector member that selectively rotates into interfering contact with a formation valve selector that is mounted on the formation valve mandrel, wherein the selector member has a collar with elongate arms spaced at angular locations on the collar and projecting axially away from the collar. The formation valve selector can be made up of an annular body with shoulders that project radially outward from the body and which are contacted by ends of the arms opposite the collar when the selector member is rotated into interfering contact with the formation valve selector. The selector assembly can also have an annular shifter assembly slotted sleeve having an outer surface with slots formed thereon that extend axially and are angularly spaced apart and that are connected by slots that extend along a circumference of the outer surface, wherein the axial and circumferential slots define a slotted path that circumscribes the outer surface. The selector member can circumscribe the outer surface, and wherein a pin can extend through a sidewall of one of the arms of the selector member and into the slotted path. In an alternative, further included with the tool is an indexing assembly on the annulus valve mandrel with slots formed axially on an outer surface of the annulus valve mandrel that are angularly spaced apart and that are connected by slots that extend along a circumference of the outer surface, wherein the axial and circumferential slots define a slotted path that circumscribes the outer surface. The tool may further include an indexing assembly on the formation valve mandrel having slots formed axially on an outer surface of the formation valve mandrel that are angularly spaced apart and that are connected by slots that extend along a circumference of the outer surface, wherein the axial and circumferential slots define a slotted path that circumscribes the outer surface.

Another example of a downhole tool for use in a wellbore includes a housing, a packer on an outer surface of the housing that defines a formation space below the packer that is in pressure communication with a formation penetrated by the wellbore, and that defines an annulus space above the packer that is in fluid communication with a wellhead assembly at an opening of the wellbore, a formation valve for selectively providing pressure communication between the formation space and to within the housing, an annulus valve for selectively providing pressure communication between the annulus space and to within the housing, a means for selectively opening one of the formation valve or annulus valve while maintaining the other one of the formation valve or annulus valve closed so that the formation space is isolated from the annulus space.

BRIEF DESCRIPTION OF DRAWINGS

Some of the features and benefits of the present invention having been stated, others will become apparent as the description proceeds when taken in conjunction with the accompanying drawings, in which:

FIG. 7 is a two dimensional view of J-slots that are part of an indexing assembly on the tool of FIG. 1 and which is in accordance with the present invention.

FIG. 9 is a two dimensional view of J-slots that are part of an indexing assembly on the tool of FIG. 1 and which is in accordance with the present invention.

Figures 1, 4:
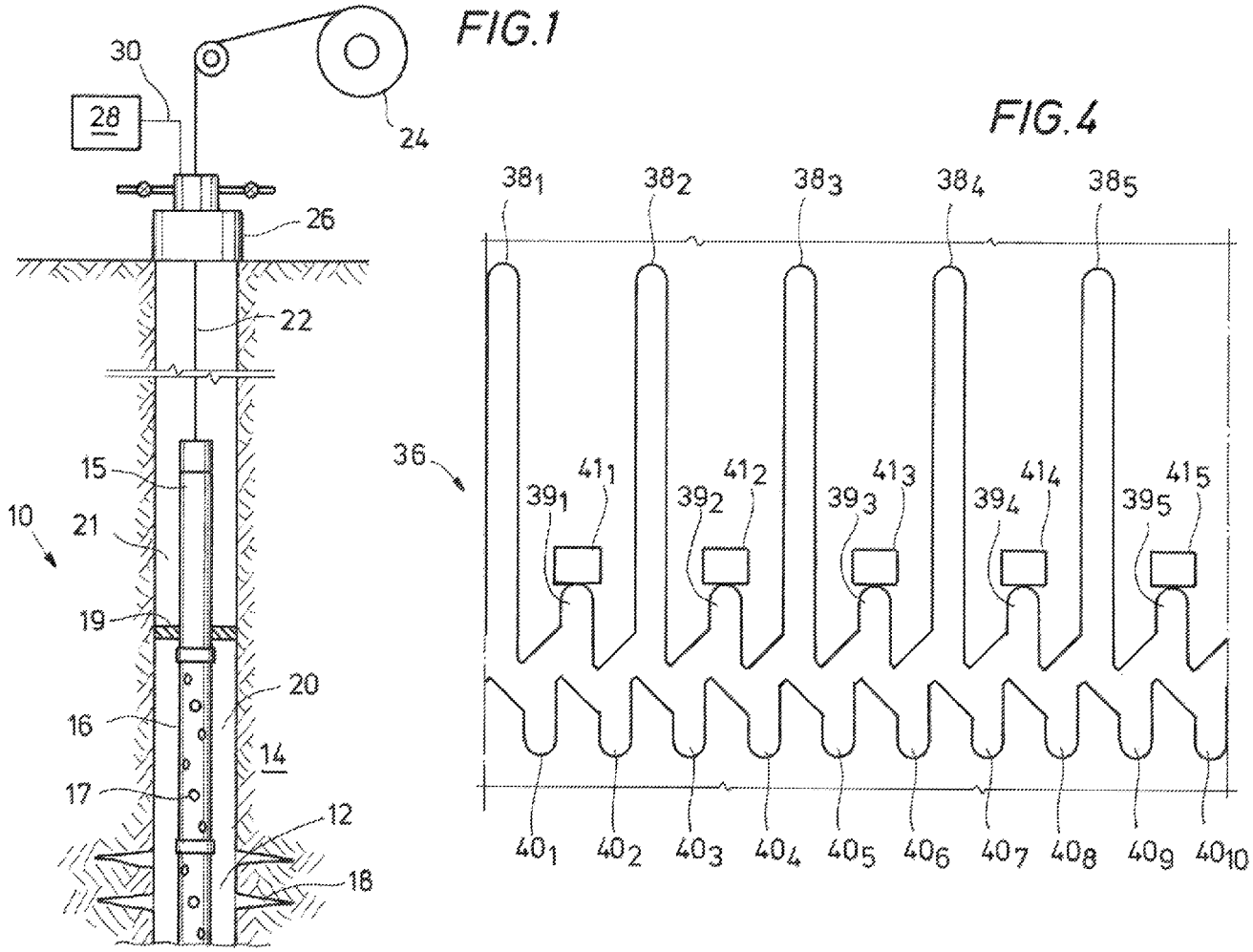
FIG. 1 is a side partial sectional view of an example of a perforating string and a tool with pressure actuated flow valves and in accordance with the present invention.
FIG. 4 is a two dimensional view of J-slots that are part of an indexing assembly on the tool of FIG. 1 and which is in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term about includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 shows in a side partial sectional view one example of a downhole string 10 suspended within a wellbore 12, where wellbore 12 intersects a subterranean formation 14. In the embodiment of FIG. 1 included with the downhole string 10 is a control tool 15, which in the illustrated embodiment is an elongate member having a cylindrical outer surface. Mounted on a lower end of control tool 15 are perforating guns 16 shown equipped with shaped charges 17. As is known, initiating detonation of the shaped charges 17 creates perforations 18 that extend through the wall of the wellbore 12 and into the formation 14. Further in the example of FIG. 1, a packer 19 is provided on an outer surface of the housing of control tool 15, and which provides a pressure and flow barrier within the annular space between the downhole string 10 and wall of wellbore 12. As shown, packer 19 defines a formation space 20 below the packer 19 which is in pressure communication with formation 14 via perforations 18. Packer 19 further defines an annulus space 21 above packer 19 and which is in pressure and fluid communication with an opening of wellbore 12. Tubing 22 from reel 24 on the Earth's surface is provided for deploying the downhole string 10, and through which fluid may be selectively supplied to the downhole string 10. A wellhead assembly 26 is on surface at the opening of wellbore 12 and in pressure communication with annular space 21. An optional pressure source 28 is provided on surface and for delivering pressurized fluid to within annulus space 21 via discharge line 30 shown connecting through wellhead assembly 26. As will be described in more detail below, selectively pressurizing annulus space 21 actuates mechanisms within control tool 15 for selectively providing communication between formation space 20 and inside of tool 15, or selectively providing communication between annulus space 21 and inside of tool 15. Moreover, the assembly is designed to isolate communication between formation space 20 and annulus space 21 through the control tool 15.

Figure 2A:
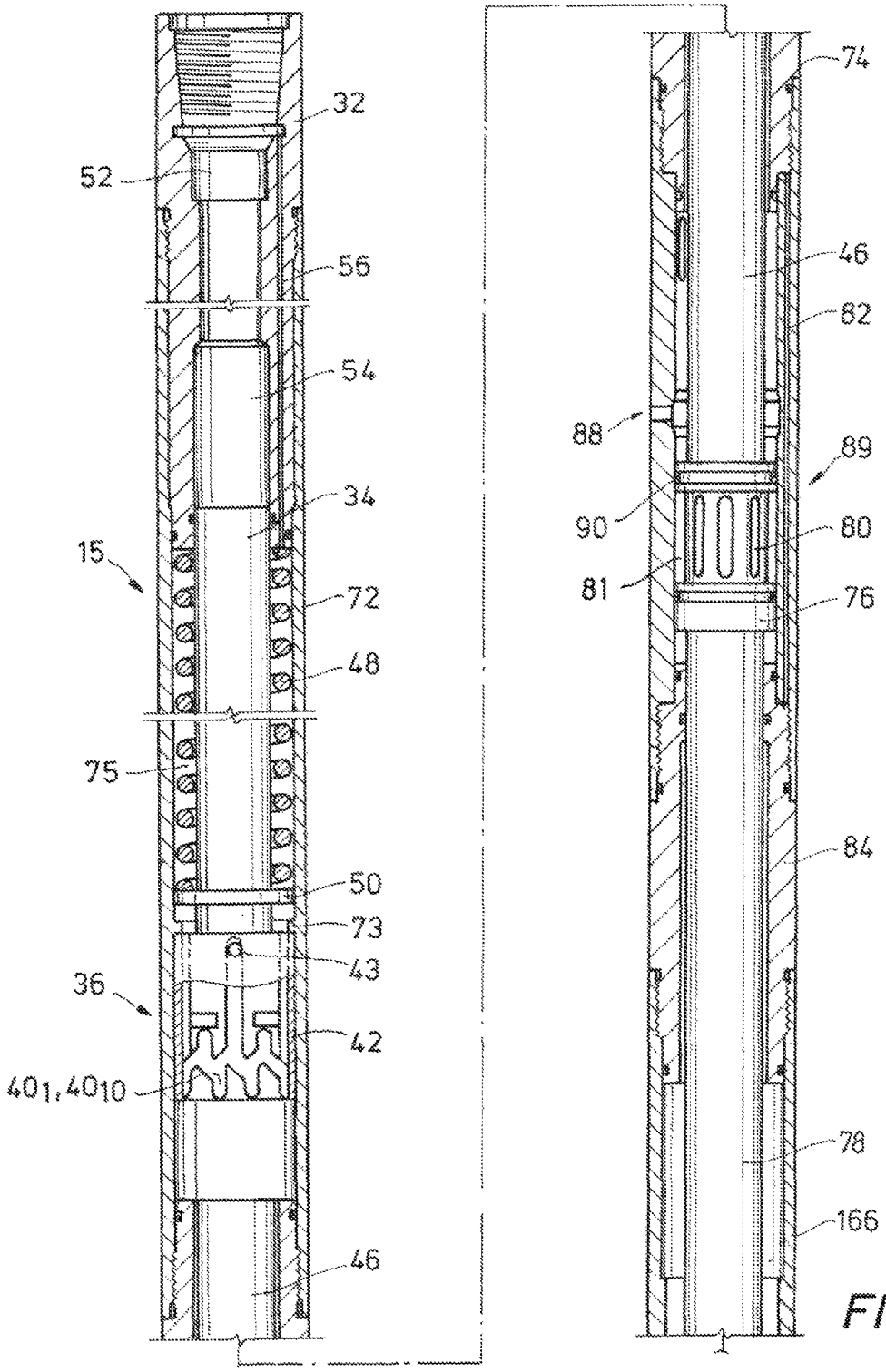
FIGS. 2A-2K are side partial sectional views of an example of the tool of FIG. 1 and which illustrate an operational sequence of the tool and that is in accordance with the present invention.
Figure 2A:
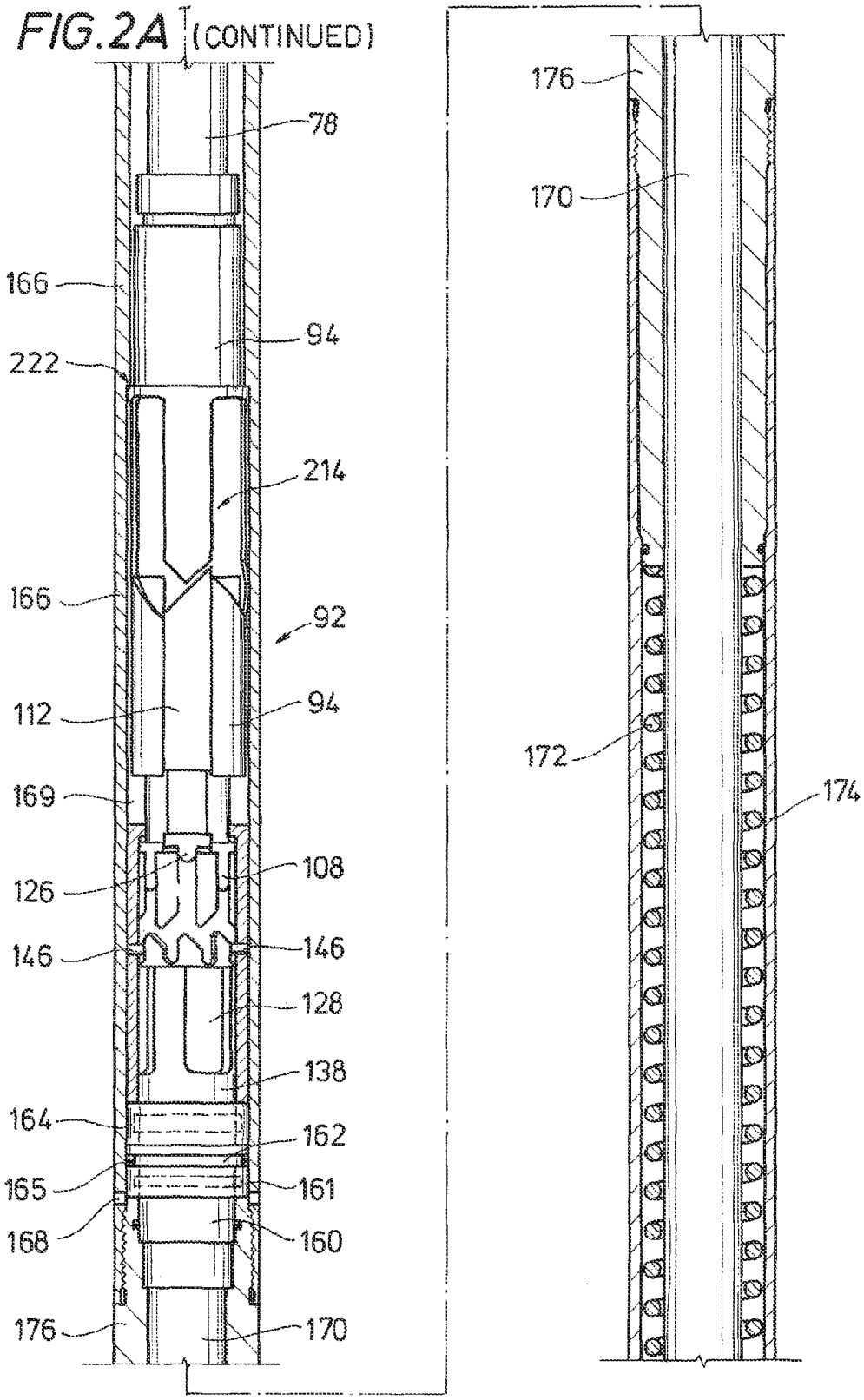
Figure 2A:
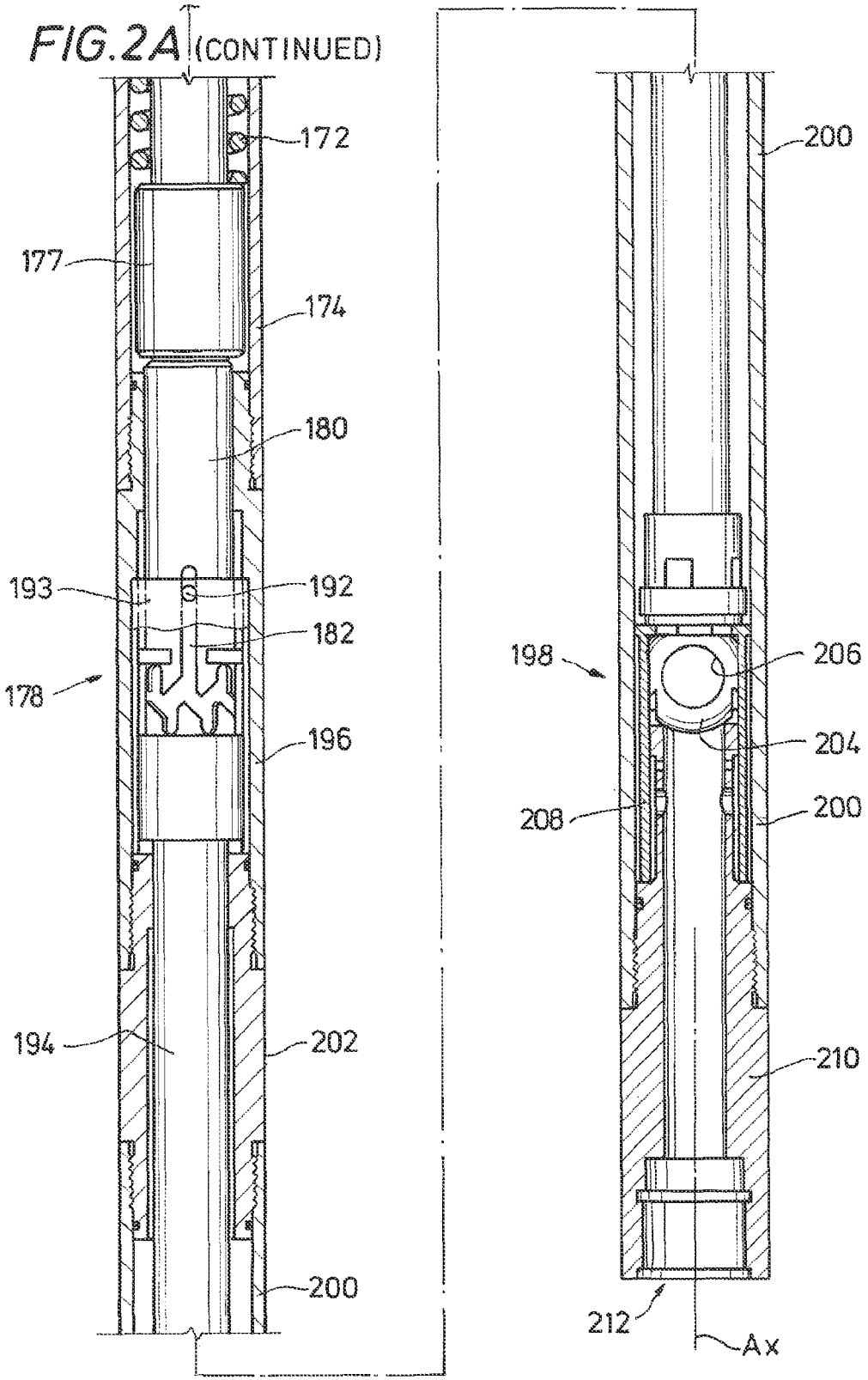

A partial side sectional example of the control tool 15 is provided in FIG. 2A, wherein an upper end of tool 15 is equipped with an annular crossover sub 32. In the example of FIG. 2A, control tool 15 is illustrated horizontally, however, for the purposes of discussion herein downward generally refers to a direction projecting to the right in the figure, whereas upward generally refers to a direction projecting to the left. Further in the tool 15 is an elongate cylindrically shaped spring mandrel 34 shown inserted into an end of sub 32. An end of spring mandrel 34 distal from crossover sub 32 couples with a sleeve valve indexing assembly 36. A two-dimensional view of the sleeve valve indexing assembly 36 is shown in a plan view in FIG. 4. As shown, the indexing assembly includes a series of elongate downward-facing slots $\mathbf{38}_1$-$\mathbf{38}_5$ formed into the outer surface of the indexing assembly 36. For the purposes of discussion herein, downward facing slots have openings on their lower ends, whereas upward facing slots have openings on their upper ends. An example of an opening in a slot defines where the slot intersects with another slot or other similar groove or depression in the surface of the body having the slot; such that where a pin or other element in the slot can move or be moved into the another slot unobstructed. In contrast, an example of a closed end of a slot is where sidewalls of the slot define an obstruction to free passage of the pin or other element in the slot.

Slots $\mathbf{38}_1$-$\mathbf{38}_5$ are spaced apart at angular locations around the indexing assembly 36. Between each adjacent elongate downward-facing slots $\mathbf{38}_1$-$\mathbf{38}_5$ are downward-facing slots $\mathbf{39}_1$-$\mathbf{39}_5$ that have a shorter axial length than the elongate downward-facing slots $\mathbf{38}_1$-$\mathbf{38}_5$. A series of upward-facing slots $\mathbf{40}_1$-$\mathbf{40}_{10}$ are further illustrated in FIG. 4 and that are angularly spaced apart from one another and between adjacent ones of the downward-facing slots $\mathbf{38}_1$-$\mathbf{38}_5$ and $\mathbf{39}_1$-$\mathbf{39}_5$. Slots $\mathbf{38}_1$-$\mathbf{38}_5$, $\mathbf{39}_1$-$\mathbf{39}_5$, $\mathbf{40}_1$-$\mathbf{40}_{10}$, can be formed directly on an outer surface of spring mandrel 34, or on another member having a continuous curved outer surface and that is coaxially mounted with spring mandrel 34. The slots $\mathbf{38}_1$-$\mathbf{38}_5$, $\mathbf{39}_1$-$\mathbf{39}_5$, $\mathbf{40}_1$-$\mathbf{40}_{10}$ are created by forming depressions within the outer surface of the spring mandrel 34 (or other member coupled to spring mandrel 34 as described above) and form a continuous path circumscribing the outer surface of spring mandrel 34. Optionally, indexing lugs $\mathbf{41}_1$-$\mathbf{41}_5$ are provided at the upper terminal end of downward-facing slots $\mathbf{39}_1$-$\mathbf{39}_5$; which can provide added obstruction at the closed end of the $\mathbf{39}_1$-$\mathbf{39}_5$.

Referring back to FIG. 2A, an annular sleeve valve indexing collar 42 is shown circumscribing the slots $\mathbf{38}_1$-$\mathbf{38}_5$, $\mathbf{39}_1$-$\mathbf{39}_5$, $\mathbf{40}_1$-$\mathbf{40}_{10}$. A pin 43 projects radially inward from the collar 42 and selectively into a one of the slots $\mathbf{38}_1$-$\mathbf{38}_5$, $\mathbf{39}_1$-$\mathbf{39}_5$, $\mathbf{40}_1$-$\mathbf{40}_{10}$ so that axial movement of spring mandrel 34 can selectively rotate and/or axially displace spring mandrel 34 within control tool 15, as will be described in more detail below. Sleeve valve indexing collar 42 is shown in a phantom view so that the slots $\mathbf{38}_1$-$\mathbf{38}_5$, $\mathbf{39}_1$-$\mathbf{39}_5$, $\mathbf{40}_1$-$\mathbf{40}_{10}$ (FIG. 4) are visible through the collar 42.

An elongate and cylindrical mandrel 46 is shown connected to an end of the sleeve valve indexing assembly 36 opposite its connection to spring mandrel 34. Further, a spring 48 is shown circumscribing spring mandrel 34, on a lower end of spring 48 is ring-like spring backstop 50 shown mounted around the outer surface of the spring mandrel 34. The upper end of spring 48 contacts a lower end of crossover sub 32. As shown, an axial bore 52 extends through crossover sub 32 and which has an upper end that flares radially outward and for receiving a connection of a tubular (not shown). Bore 52 has a reduced radius in the middle portion of crossover sub 32, expands radially outward to define a cavity 54 adjacent spring mandrel 34, and receives spring mandrel 34 in cavity 54. As such, spring mandrel 34 can be inserted into cavity 54 that in turn compresses spring 48 and stores an axial force for moving spring mandrel 34 downward and away from crossover sub 32.

Figure 3:
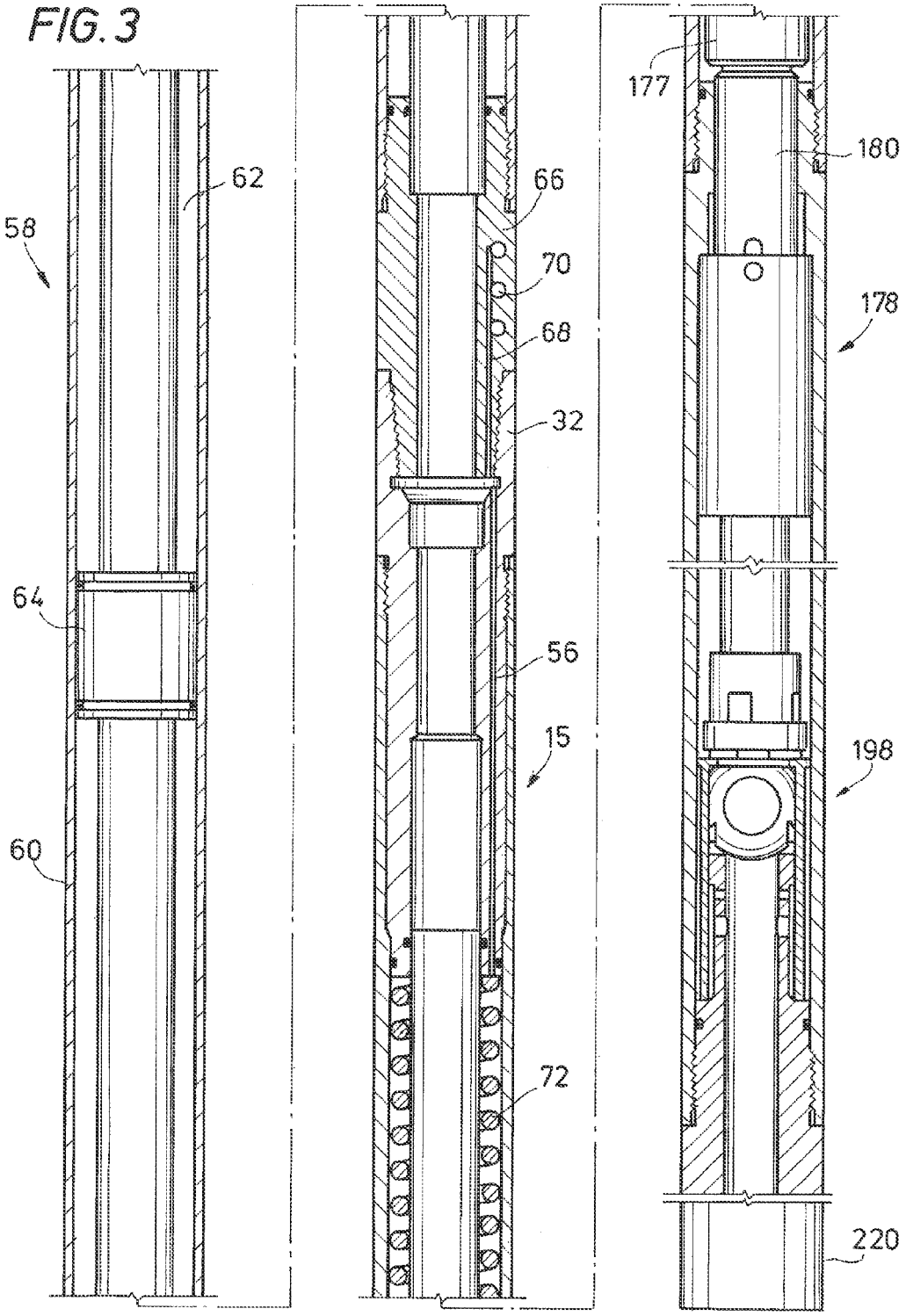
FIG. 3 is a side partial sectional view of the tool of FIG. 1 and with an attached nitrogen charge assembly and in accordance with the present invention.

Formed axially through a sidewall of crossover sub 32 is a gun drill passage 56 that provides communication to an annular space surrounding spring mandrel 34 and the upper opening of bore 52. Referring now to FIG. 3, an example of a nitrogen charge assembly 58 is shown mounted on an upper end of control tool 15 and which provides a source of pressurized nitrogen that can be delivered to control tool 16 via gun drill passage 56. In the example of FIG. 3, the nitrogen charge assembly 58 includes an annular housing 60 with an axial bore 62 having a piston 64 that travels axially within bore 62. A connection sub 66 threadingly couples the housing 60 to crossover sub 32 and which also includes an axial gun, drill passage 68 formed axially through which registers with and is in communication with gun drill passage 56. Fill ports 70 are shown extending through the connection sub 66 and intersecting the gun drill passage 68, and can be used to inject a fluid, such as nitrogen, into the gun drill passage 68, where the fluid can directed to open spaces within control tool 15 (FIG. 2A). In one non-limiting example of operation, the nitrogen charge assembly 58 delivers a nitrogen charge to the tool 15 via fill ports 70 prior to deploying the tool 15 into the wellbore 12. Optionally, multiple fill ports 70 are provided to enhance safety of the filling process and so that block and bleed valves (not shown) can be utilized.

Referring back to FIG. 2A, an upper housing 72 is shown covering the spring mandrel 34 and sleeve valve indexing assembly 36. A shoulder 73 is formed where the diameter of the inner surface of housing 72 reduces, and which defines a backstop for the sleeve valve indexing collar 42. A lower end of sleeve valve indexing collar 42 is in contact with an upper connector sub 74 which is shown threadingly inserted into a lower end of upper housing 72. A combination of the shoulder 73 and upper connector sub 74 restrains the sleeve valve indexing collar 42 in a set axial position within housing 72. The housing 72 further defines an inner space 75 within control tool 15.

A sleeve valve 76 is shown provided on a lower end of upper sleeve valve mandrel 46, which is an annular member having a lower end connecting to an elongate cylindrically-shaped lower sleeve valve mandrel 78. Slots 80 are formed through a sidewall of the sleeve valve 76 so that a passage (not shown) extending axially through spring mandrel 34, sleeve valve indexing assembly 36 and upper sleeve valve mandrel 46 can communicate to a space 81 between the outer surface of sleeve valve 76 and inside of a sleeve valve housing 82. Sleeve valve housing 82 threadingly attaches on its upper end to a lower end of upper connector sub 74 and on its lower end to an annular sleeve valve connector sub 84. A port 88 is shown formed radially through a sidewall of sleeve valve housing, thereby communicating a portion of the space 81 adjacent port 88 with the ambient environment adjacent the outer surface of sleeve valve housing 82. The combination of the sleeve valve 76, slots 80, and port 88 define a sleeve valve assembly 89. The sleeve valve assembly 89 is shown in a closed position in that the slots 80, and thus the axial passage within mandrel 42, are separated from the port 88 by 0-ring seals 90 (or other types of seals) that circumscribe the body of the sleeve valve 76. As will be described in more detail below, axially moving mandrel 78 so that slots 80 register with port 88 opens communication between the axial passage and outside of housing 82.

Figure 5:
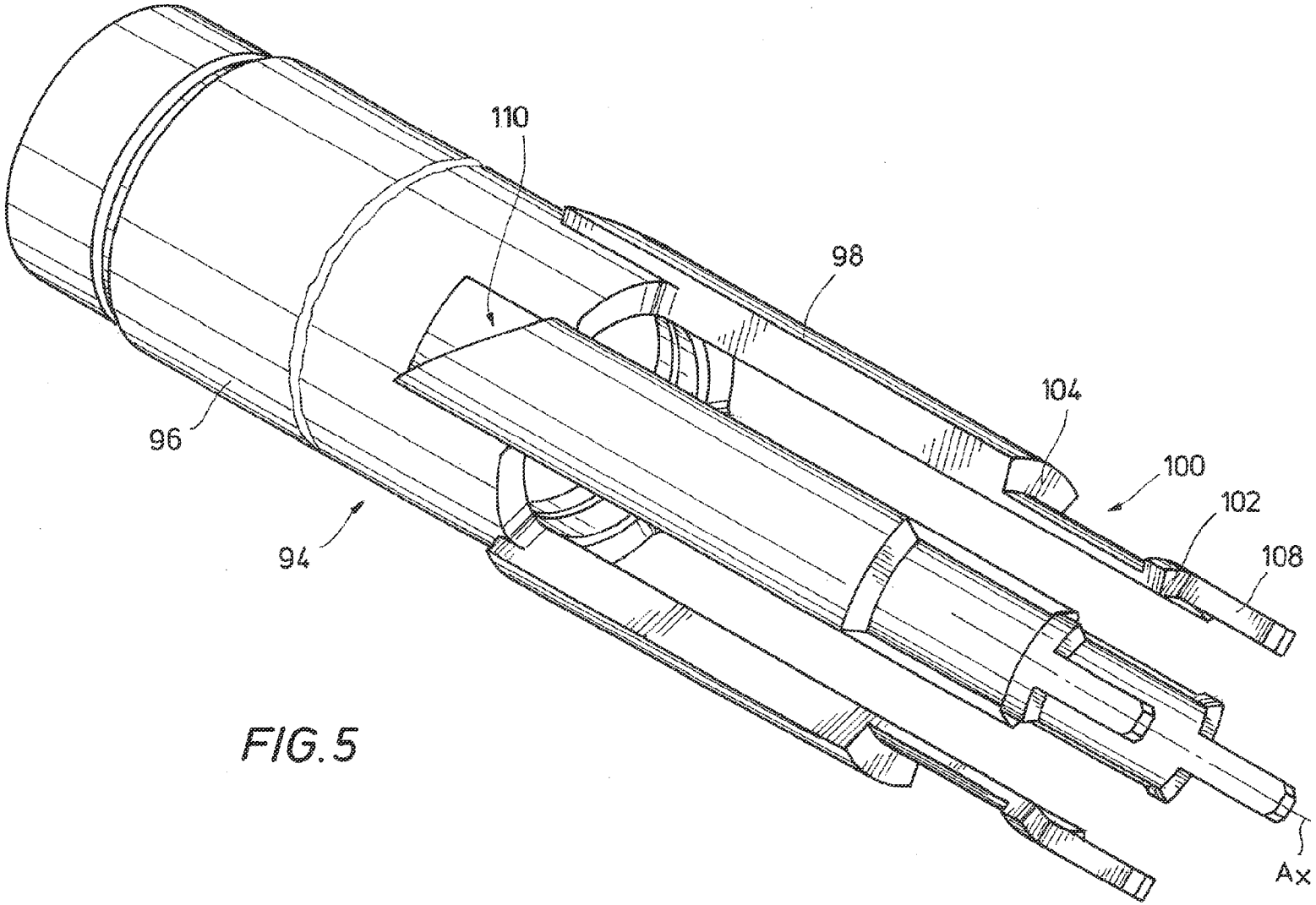
FIG. 5 is a side perspective view of an example of a sleeve valve selector, which is part of a selector assembly on the tool of FIG. 1 and which is in accordance with the present invention.

Spaced axially downward from sleeve valve connector sub 84 is a shifter assembly 92, which includes an annular sleeve valve selector 94 whose upper end couples with a lower end of lower sleeve valve mandrel 78. Referring now to FIG. 5, shown in a side perspective view is one example of sleeve valve selector 94 which includes an annular body 96 having fingers 98 that project axially away from body 96 and in a downward direction. Fingers 98 are on the circumference of the body 96 and angularly spaced apart from one another about the axis $A_x$ of the sleeve valve selector 94. Each of the fingers 98 is shown having a recess 100 formed on their respective outer surfaces and at ends distal from body 96. Recesses 100 extend radially inward from the outer surface of the fingers 98, and define upward-facing retention shoulders 102 on ends of recesses 100 distal from body 96. Similarly, downward-facing shoulders 104 are formed on ends of recesses 100 proximate body 96. Elongate alignment teeth 108 are formed on terminal ends of each leg 98 that project axially away from body 96. Still referring to FIG. 5, the outer radial surfaces of fingers 98 project radially outward from the outer surface of body 96 so that the upper terminal ends 110 of the fingers 98 define ledges that project radially outward from the outer surface of body 96; and are profiled such that they extend along a path helical to the axis $A_x$ of the sleeve valve selector 94.

Referring back to FIG. 2A, an annular ball valve selector 112 is shown coaxially mated with sleeve valve selector 94. A perspective view of an example of ball valve selector 112 is provided in FIG. 6 where ball valve selector 112 includes an annular collar 113 and elongate legs 114 that extend axially away from collar 113. Proximate an upper end of collar 113 the legs 114 project radially outward to define downward-facing shoulders 116. The ends 118 of legs 114 distal from shoulder 116 are profiled to form a helical path with respect to the axis $A_x$ of ball valve selector 112. Proximate the lower end of collar 113 the legs 114 again project radially outward to define upward-facing shoulders 120. Recesses 122 are formed in spaces between the downward-facing shoulders 116 and upward-facing shoulders 120. The lower ends of legs 114, distal from ends 118, are provided with teeth 126 that project axially downward from upward-facing shoulder 120.

Further included in the example of the shifter assembly 92 of FIG. 2A is an annular shifter assembly slotted sleeve 128, illustrated below and coaxially coupled with the sleeve valve selector 94 and ball valve selector 112. As shown in FIG. 7, a series of raised lands $\mathbf{130_1}$-$\mathbf{130_8}$ are provided on the outer surface of the slotted sleeve 128. Between adjacent ones of the lands $\mathbf{130_1}$-$\mathbf{130_8}$ are slots $\mathbf{132_1}$-$\mathbf{132_8}$. As shown in FIG. 7, the lands $\mathbf{130_1}$-$\mathbf{130_8}$ are generally elongate members having an upward facing surface projecting along a path coaxial with the slotted sleeve 128, whereas the lower surfaces of the lands $\mathbf{130_1}$-$\mathbf{130_8}$ are profiled generally helical to the axis axis $A_x$ of the slotted sleeve 128. Castellated profiles $\mathbf{134_1}$-$\mathbf{134_8}$ are shown disposed below the lands $\mathbf{130_1}$-$\mathbf{130_8}$, and are offset from the lands $\mathbf{130_1}$-$\mathbf{130_8}$. Between adjacent profiles $\mathbf{134_1}$-$\mathbf{134_8}$ upward-facing slots $\mathbf{136_1}$-$\mathbf{136_8}$ are defined. The offset location of the profiles $134_1$-$134_8$ thereby form the upward-facing slots $136_1$-$136_8$ to be offset from the slots $132_1$-$132_8$. Moreover, the upper ends of slots $132_1$-$132_8$ are open, and as shown in FIG. 2A are engageable by the alignment teeth 108, 126 respectively of the sleeve valve selector 94 and ball valve selector 112. The upward-facing slots $136_1$-$136_8$ have a lower end that is closed.

Figure 8:
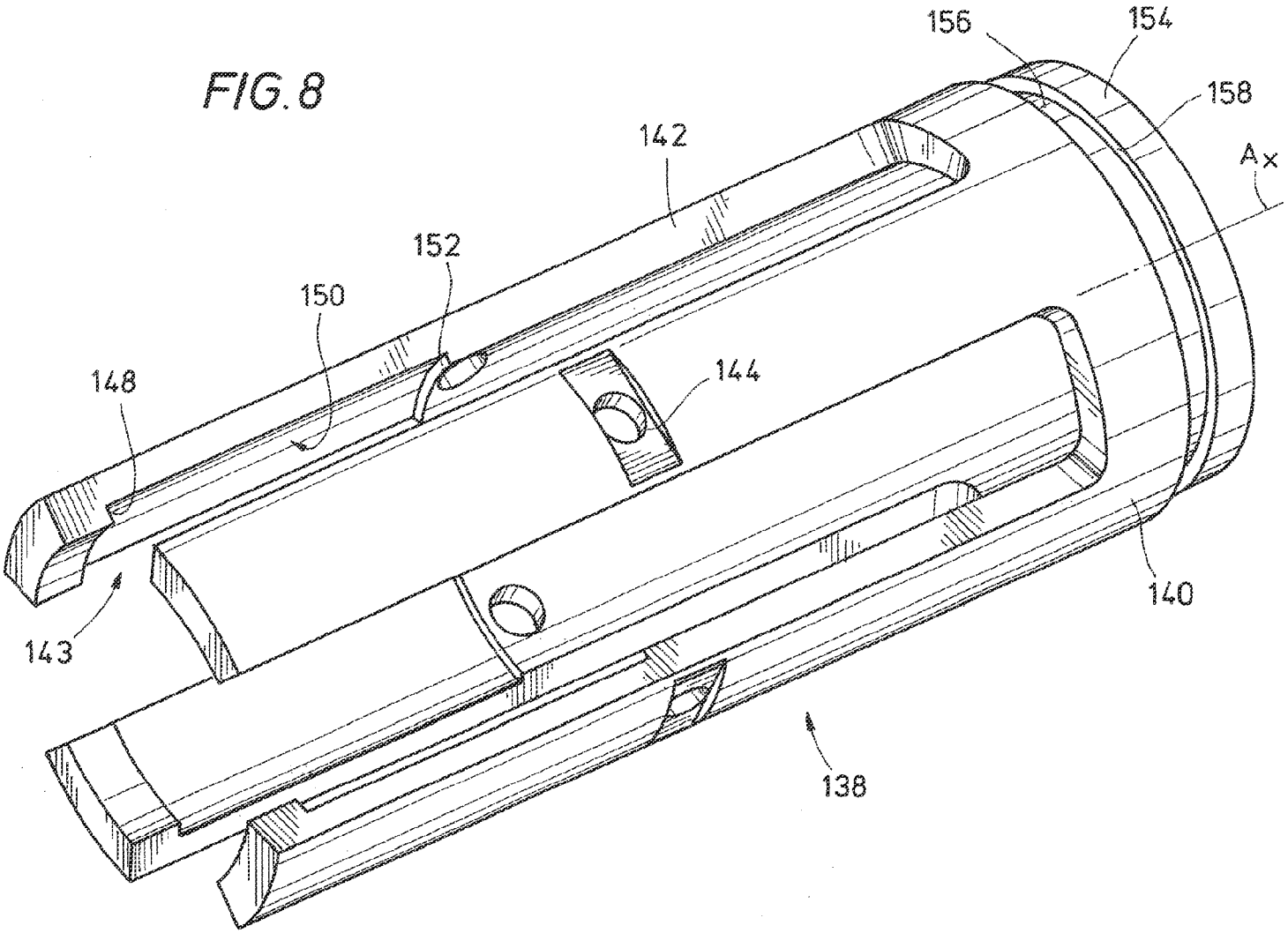
FIG. 8 is a side perspective view of an example of a selector ram, which is part of a selector assembly on the tool of FIG. 1 and which is in accordance with the present invention.

Referring back to FIG. 2A, further included with the shifter assembly 92 is a selector member 138, which as shown in perspective view in FIG. 8 is an annular member having a ring-like body 140 and elongated arms 142 that extend axially upward from body 140. The strategic positioning of the arms 142 at angular locations around body 140 defines axial slots 143 between adjacent arms 142. Further, the arms 142 have openings 144 projecting radially through their sidewalls. Pins 146 (FIG. 2A) insert through the openings 144 and into the slots $132_1$-$132_8$, $136_1$-$136_8$. Ends of the legs 142 distal from body 140 project radially inward to form a downward-facing shoulder 148. Recesses 150 are shown adjacent shoulders 148 that extend downward along the inner-facing surface of legs 142 and that terminate at upward facing shoulders 152; upward facing shoulders 152 are above openings 144. The lower end of selector member 138 forms a ring-like collar 154 that is spaced axially away from body 140. A groove 156 is formed in the circumferential surface between collar 154 and body 140 and which forms a lip 158 shown facing upward and towards body 140.

Referring back to FIG. 2A, the slotted sleeve 128 has an enlarged diameter portion which defines a base 160 and that is spaced axially downward on an end distal from the slots $136_1$-$136_8$. Between the slots and base 160 is a disk-like piston 162 which is coupled to the selector member 138 with a bearing ring 164. A seal 165 circumscribes the outer periphery of piston 162, and a shifter assembly housing 166 is provided that covers shifter assembly 92. Seal 165 defines a pressure barrier between piston 162 and inner surface of a shifter assembly housing 166. Further, a seal (not shown) may be provided between piston 162 and slotted sleeve 128 that defines a pressure and flow barrier between piston 162 and slotted sleeve 128. An upper end of shifter assembly housing 166 threadingly couples with sleeve valve connector sub 84 and a port 168 is formed through a sidewall of the housing 166. Port 168 provides fluid communication between the outer surface of housing 166 and to an annulus space 169 formed between shifter assembly 92 and housing 166. As described in more detail below, selectively pressurizing the environment ambient to the outer surface of housing 166, pressurizes annulus space 169 via port 168, which can urge piston 162 and selector member 138 upward.

The shifter assembly slotted sleeve 128 coaxially mounts on an upper end of an elongated and cylindrical spring mandrel 170 that is shown having a portion circumscribed by a spring 172, spring mandrel 170 and spring 172 are housed within a lower spring housing 174. An upper end of lower spring housing 174 threadingly mounts into a shifter assembly connector sub 176, whose upper end threadingly couples into a lower end of shifter assembly housing 166. An upper end of spring 172 is contactable with a lower end of shifter assembly connector sub 176 and a lower end of spring rests on a cylindrical hub 177 shown mounted on spring housing 170 and which has a diameter greater than a diameter of spring mandrel 170. Optionally, a bearing (not shown) is provided between spring 172 and hub 177.

Below hub 177 is a ball valve indexing assembly 178 which includes a cylindrically-shaped ball valve indexing mandrel 180 that as shown in FIG. 9, includes elongate axial slots $182_1$-$182_2$, downward-facing slots $184_1$-$184_6$, and upward-facing slots $186_1$-$186_8$. FIG. 9 is a two-dimensional representation of the slots $182_1$-$182_2$, $184_1$-$184_6$ formed in the indexing mandrel 180 and which illustrates that downward-facing slots $184_1$-$184_3$ are disposed between elongate slots $182_1$-$182_2$. Similarly, downward-facing slots $184_4$-$184_6$ are between elongate slots $182_2$ and $182_1$. Upward-facing slots $186_1$-$186_8$ are angularly offset from both the elongate slots $182_1$-$182_2$ and downward-facing slots $184_1$-$184_6$. The slots $182_1$-$182_2$, $184_1$-$184_6$ define a series of downward-facing profiles $188_1$-$188_8$ whose lower surfaces run along a helical path with respect to the axis $A_x$ of the indexing mandrel 180. Similarly, the upward-facing slots $186_1$-$186_8$ define upward-facing profiles $190_1$-$190_8$ between the adjacent slots. The upper surfaces of the upward-facing profiles 190 also run along a path that is helical with respect to axis $A_x$ and that is offset by about 90° from the helical path of the downward-facing profiles $188_1$-$188_8$. As described in further detail below, a pin 192 (FIG. 2A) projects radially inward from a sleeve 193 that circumscribes the mandrel 180 and wherein pin 192 is insertable into slots $182_1$-$182_2$, $184_1$-$184_6$, $186_1$-$186_8$.

Referring back to FIG. 2A, an elongate cylindrically-shaped ball valve mandrel 194 coaxially mounts to a lower end of indexing mandrel 180 and wherein an annular indexing housing 196 provides a covering for the indexing assembly 178. A lower end of the ball valve mandrel 194 mechanically couples with a ball valve assembly 198 shown axially downward from indexing assembly 178. The ball valve assembly 198 is contained in a ball valve assembly housing 200 having an upper end that threadingly attaches to an index sub connector 202; where the index sub connector 202 is an annular member whose upper end connects with a lower end of the index housing 196. Included with the ball valve assembly 198 is a ball member 204 shown in a closed position and with its opening 206 running generally perpendicular the axis $A_x$ of the tool 15. Further included with the ball valve assembly 198 are elongate arms 208 that run axially within the housing 196 on lateral sides of the ball member 204. Axially moving the arms 208 with respect to the ball member 204 rotates the ball member 204 to align the opening 206 coaxial to axis $A_x$ thereby providing communication with the inside of tool 15 and formation space 20 (FIG. 1). An annular tool connector sub 210 is shown coaxially threaded into a lower end of housing 200 and which includes an axial passage 212 that provides communication between tool 15 and any downhole tool connected thereon, such as the perforating gun 16 (FIG. 1).

Figure 10:
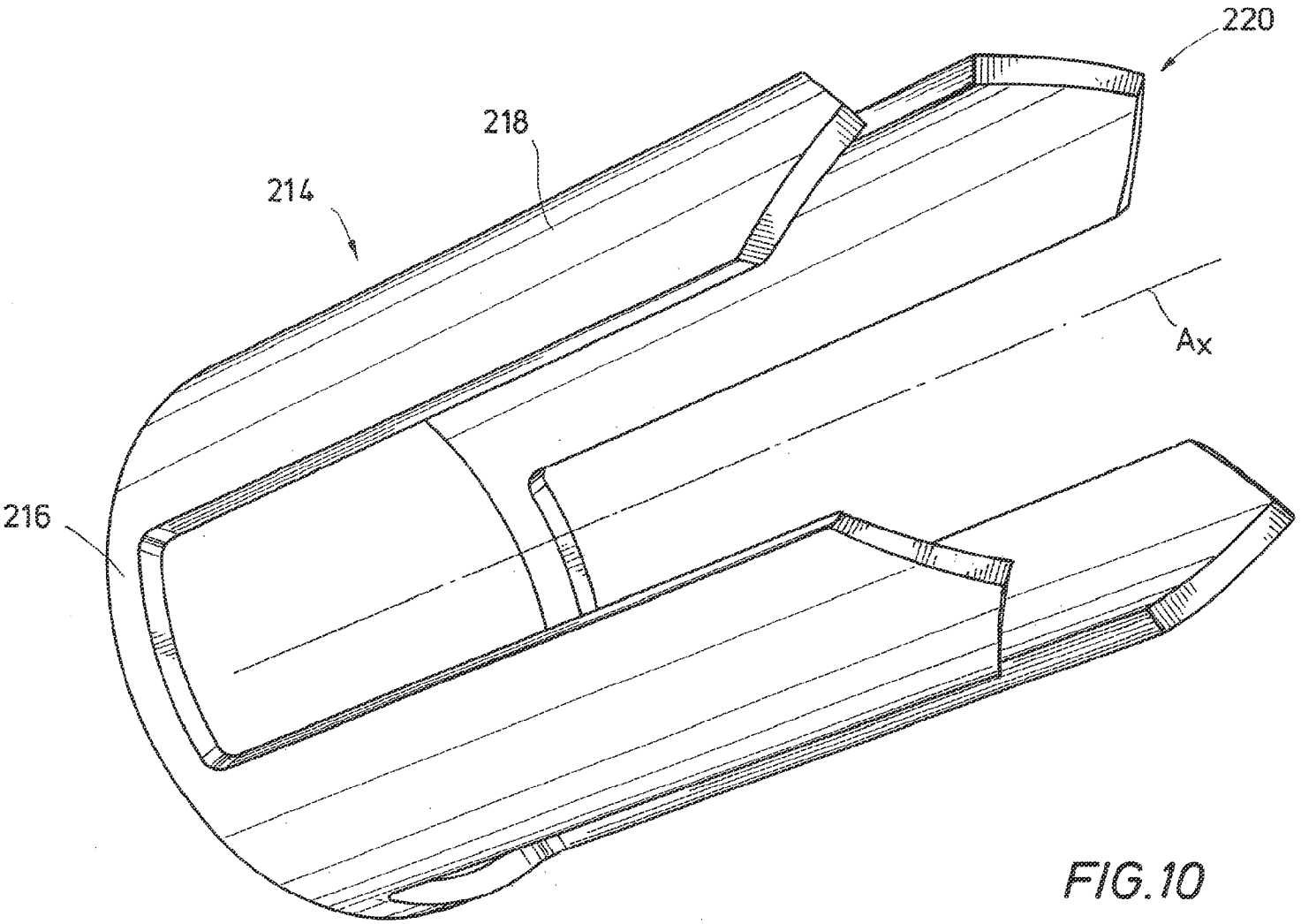
FIG. 10 is a side perspective view of an example of a stop ring, which is part of a selector assembly on the tool of FIG. 1 and which is in accordance with the present invention.

Still referring to FIG. 2A, a stop ring 214 is shown which is further included with the shifter assembly 92. Stop ring 214, which is an optional element, is shown in perspective view in FIG. 10 and which includes a ring-like body 216 having a series of arms 218 attached to the body 216 and extending axially downward from body 216. The ends of the arms 218 distal from body 216 are profiled to form a crest 220 proximate the mid portion of the lower end of each arm 218, and so that the surfaces on lateral sides of the crest 220 project helically away from one another and generally upwards towards body 216.

As indicated above, an advantage of the tool 15 described herein is that through the tool 15 communication can take place between the formation space 20 and tubing 22 thereby allowing direct flow from within the formation 14 to the surface and through tubing 22. Optionally, recirculation flow can take place through tool 15 and into the annulus space 22 so that fluid can be recirculated through the tubing 22, tool 15 into annulus space 21 and back to surface through the wellhead assembly 26. Tool 15, however, is equipped so that communication from the formation space 20 to annulus space 21 is prohibited through the tool 15. That is, the sleeve valve assembly 89 will remain closed as long as ball valve assembly 198 is open, and vice versa. In one example of operation, pressure applied into the annulus space 21 and to the ambient environment outside of the housing of tool 15 can actuate devices within the tool and achieve the designated or desired opening or closing of the specific valves. More specifically, referring back to FIG. 2A, sleeve valves 76 and ball valve assembly 198 are in a closed position. A selective opening and/or closing of these valve assemblies 89, 198 can be accomplished by sequential pressurizations and/or depressurizations of the annulus space 21, and in combination with the strategic configurations of the slots in the indexing assemblies 36, 178 and shifter assembly 92.

Figure 2B:
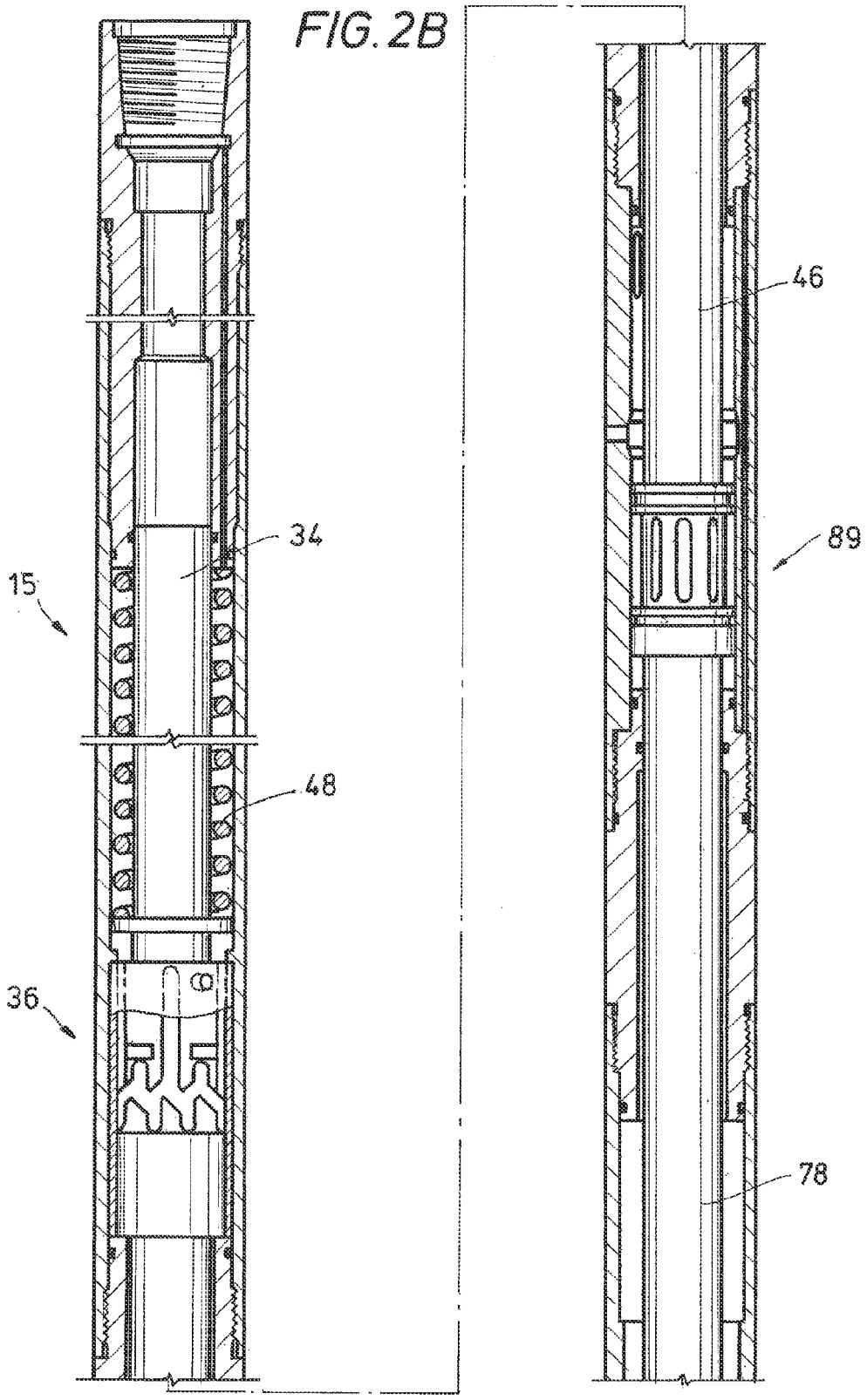
Figure 2B:
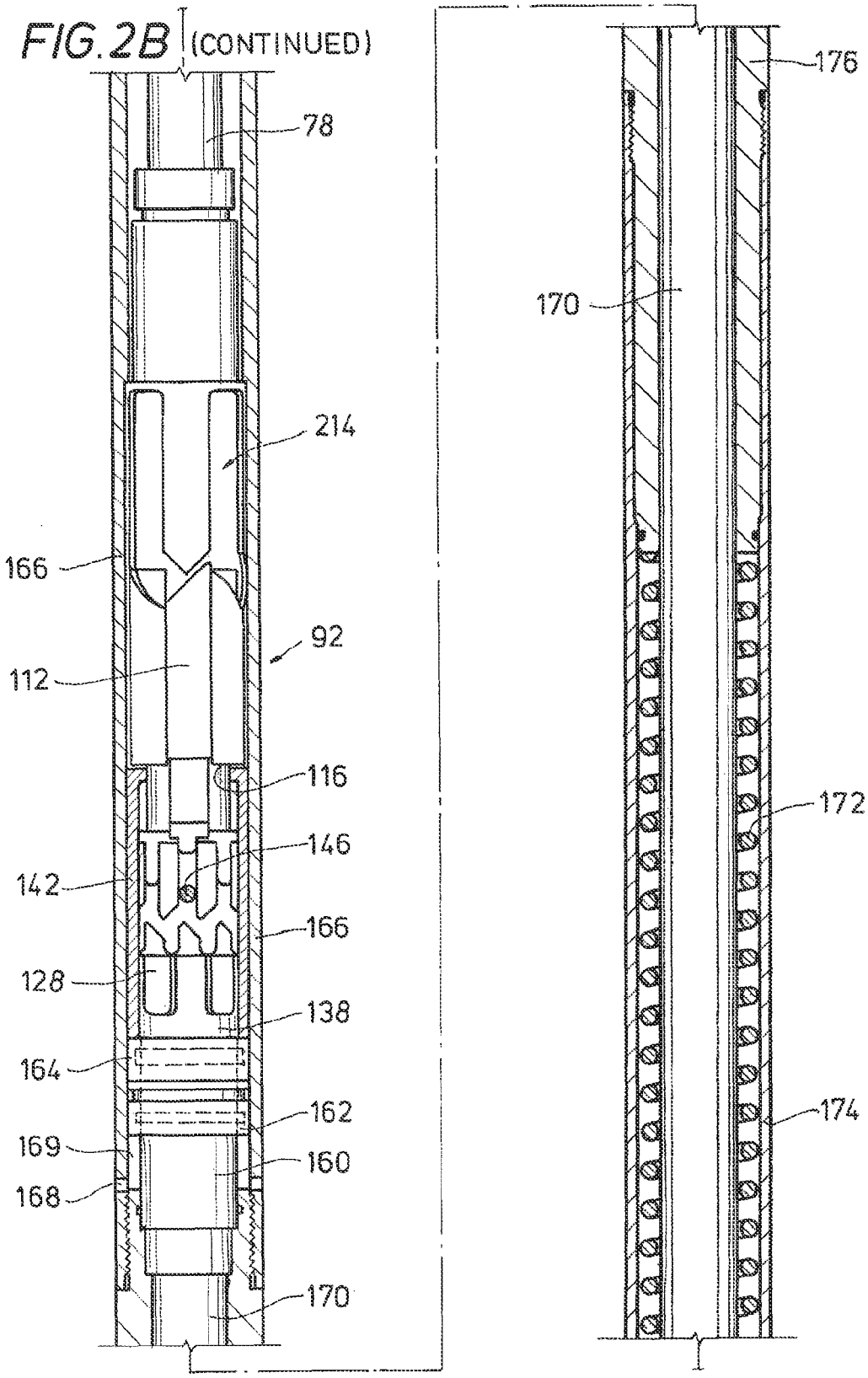
Figure 2B:
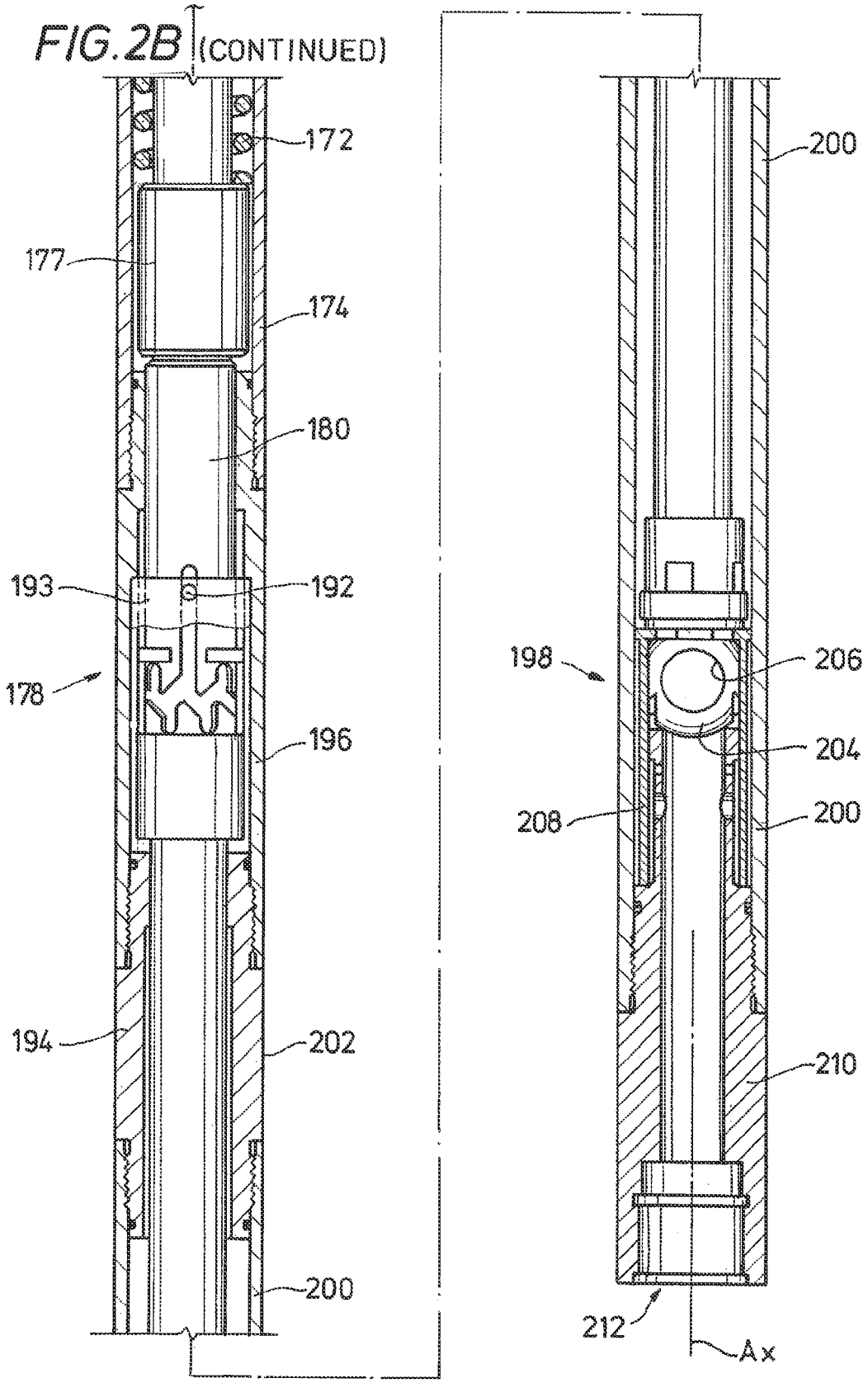

One non-limiting example of operation of the apparatus described herein is provided below. For the purposes of reference the configuration of the tool 15 in FIG. 2A coincides with a pressure $P_1$ in the annulus space 21 and the position of piston 162 is in a first position. Referring now to FIG. 2B, pressure in annulus space 21 (FIG. 1) is raised to a pressure $P_2$, wherein pressure $P_2$ is greater than pressure $P_1$. As such, fluid within the annulus space 21 enters into the annulus space 169 between housing 166 and slotted sleeve 128 to urge piston 162 axially upward and into a second position. Further illustrated in FIG. 2B is that movement of the piston 162 has in turn urged bearing ring 164 and selector member 138 axially upward so that upper ends of the arms 142 of selector member 138 are in contact with the downward-facing shoulder 116 of ball valve selector 112 and not in contact with the sleeve valve selector 94.

Figure 2C:
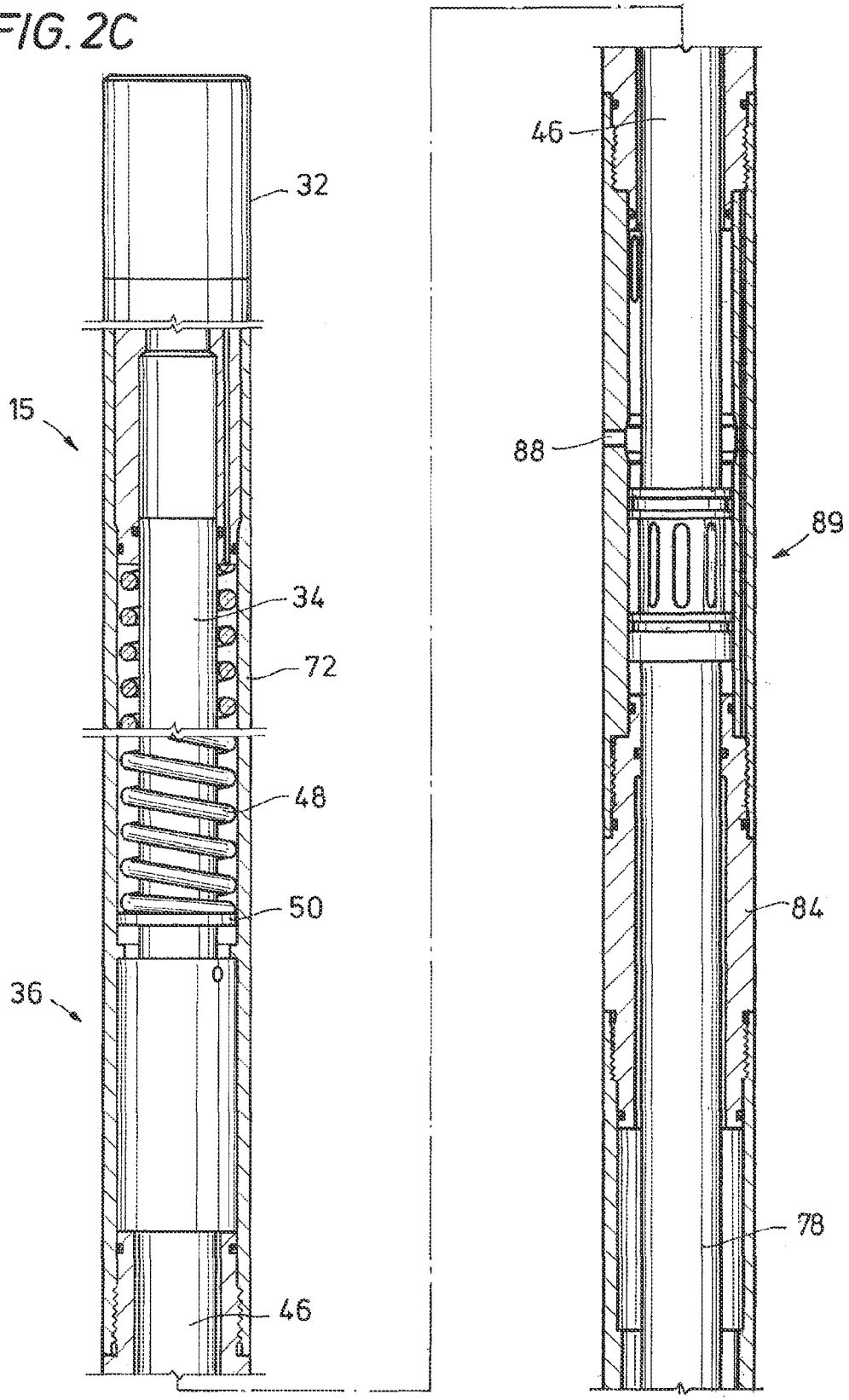
Figure 2C:
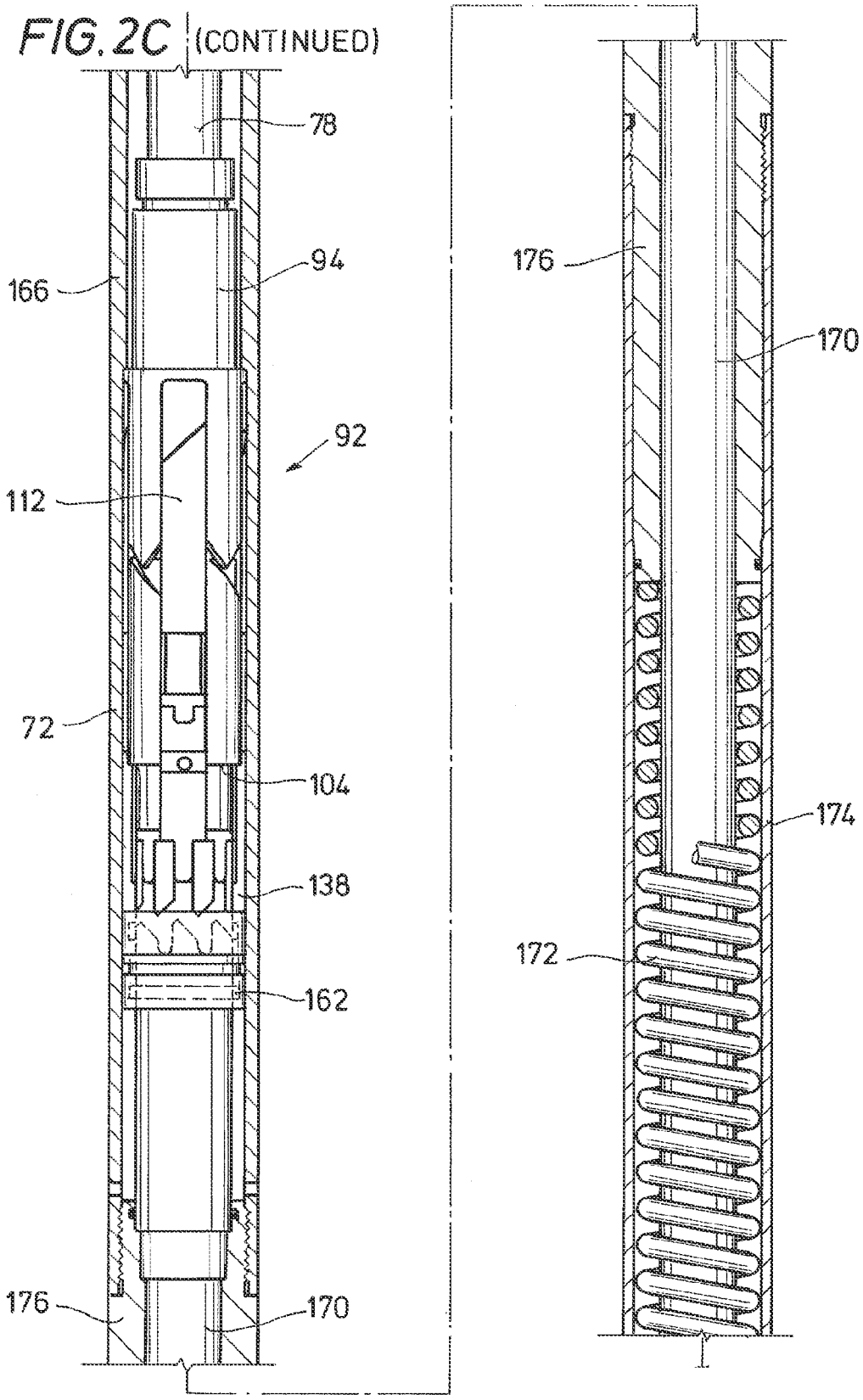
Figure 2C:
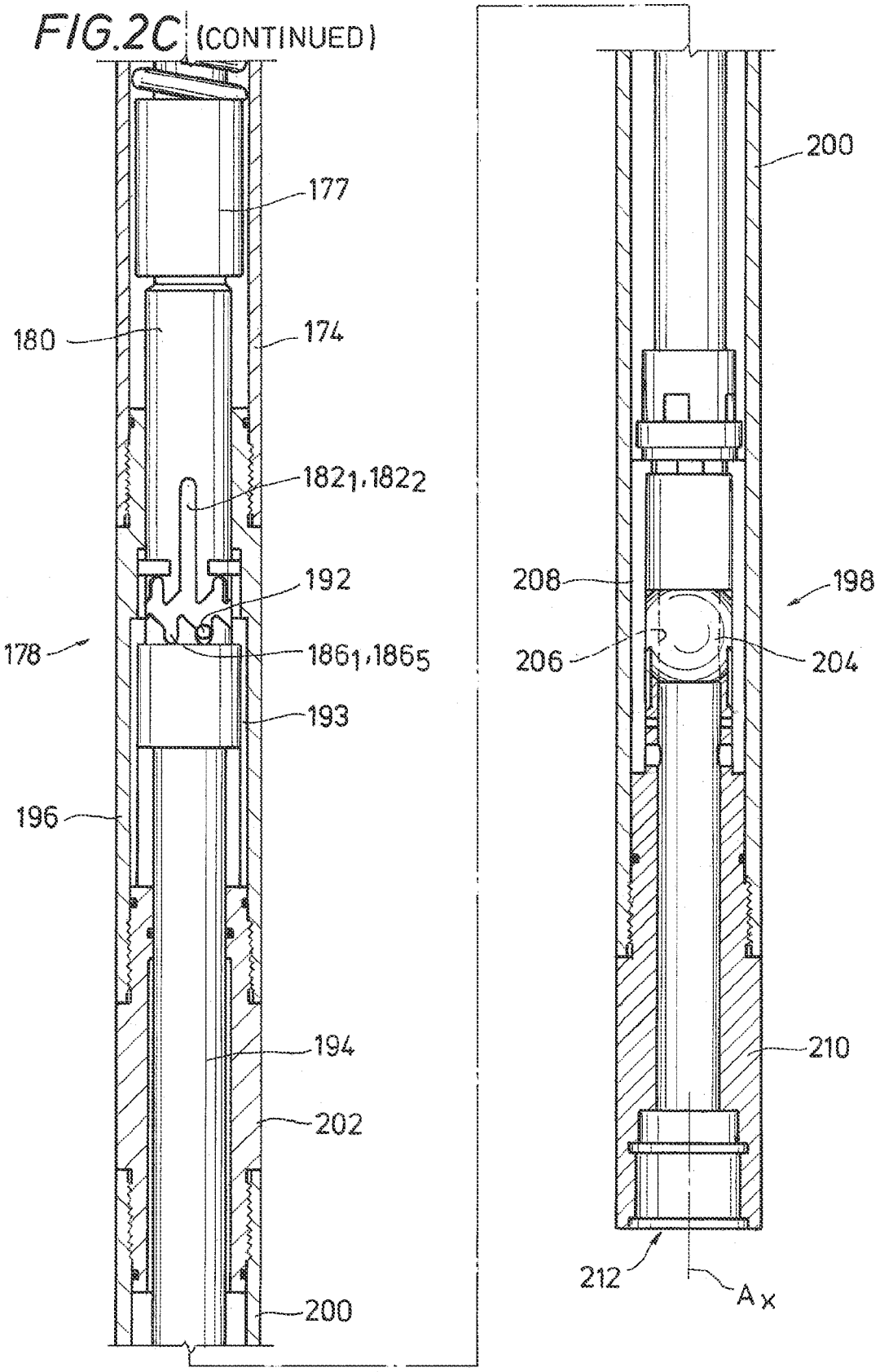

Referring now to FIG. 2C, further pressurization in the annulus space 21 brings the pressure in annulus space to a pressure designated as P4, which is greater than P2. The piston 162 is correspondingly moved upward to a fourth position and drives the selector member 138 against ball valve selector 112. Driving ball valve selector 112 upward as shown so that its downward-facing shoulder is in a plane above the downward-facing shoulder 104 of sleeve valve selector 94. Because ball valve selector 112 is coupled with spring mandrel 170, spring mandrel 170 is also drawn upward and shown compressing spring 172. Upwardly moving spring mandrel 170 also urges ball valve indexing mandrel 180 upward, as pin 192 and sleeve 193 are retained within the index housing 196, pin 192 moves out of registration with elongate slot 1821, 1822 and into an adjacent upward-facing slot (i.e., 1862, 1865) by virtue of the helically-shaped upper surface of upward-facing profile 1902, 1905 (FIG. 9). As the upward-facing slots 1861-1868 are angularly offset from elongate slots 1811, 1822, relative rotation takes place between the indexing mandrel 180 and sleeve 193. Moreover, as pin 192 lands in upward-facing slots 1861-1865, additional upward movement of indexing mandrel 180 and spring mandrel 170 is prevented until pin 192 is positioned in another slot. Further shown in FIG. 2C is that upward movement of the indexing mandrel 180 in turn pulls ball valve mandrel 194 and the attached assembly arms 208 upward, which rotates ball member 204 into an open position so that opening 206 (FIG. 2A) is now coaxial with the axis AX of tool 15. In this configuration, the ball valve assembly 198 provides fluid communication from the formation space 20 and to inside of tool 15 (FIG. 1), and thus can be referred to as a formation valve.

Figure 2D:
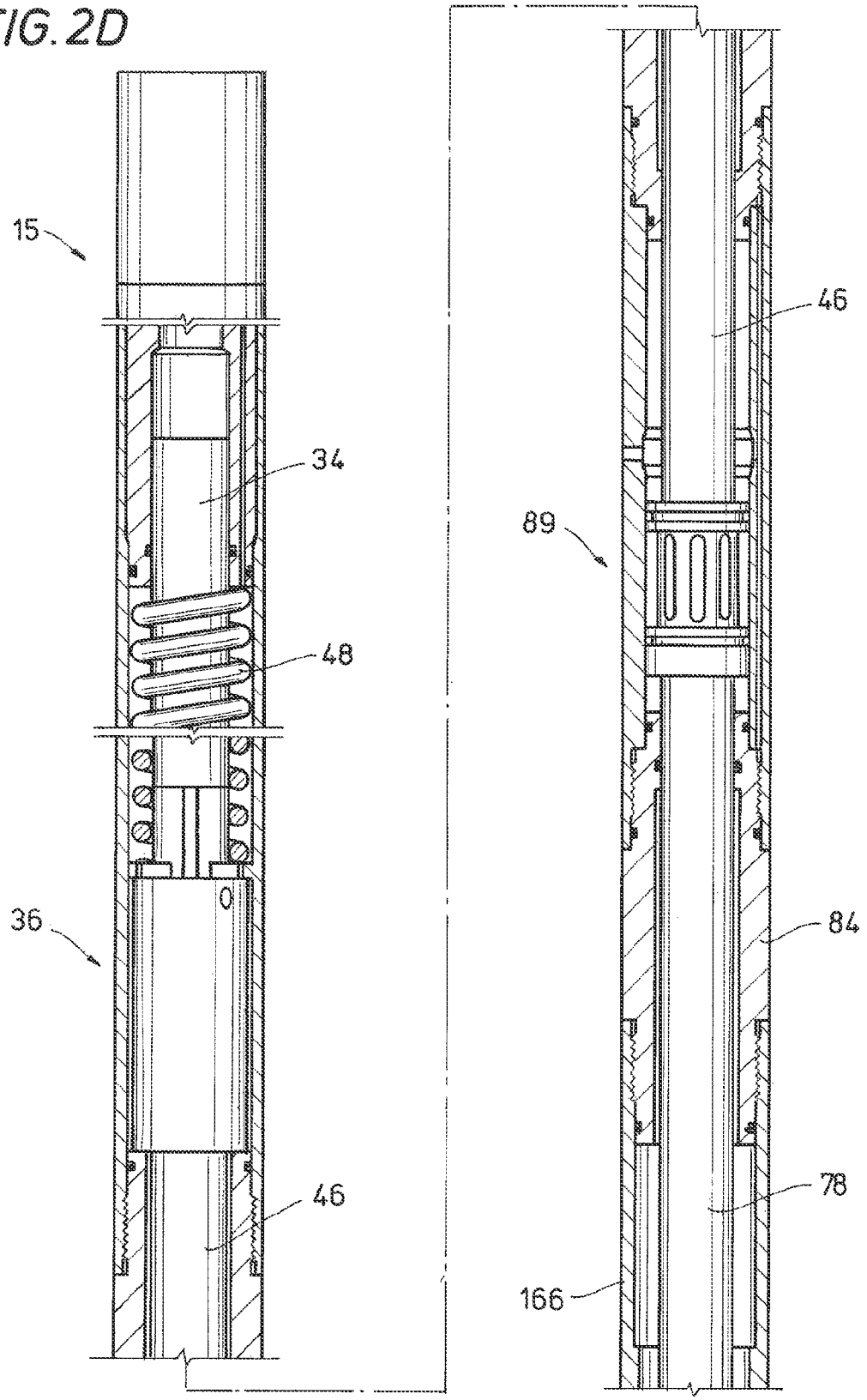
Figure 2D:
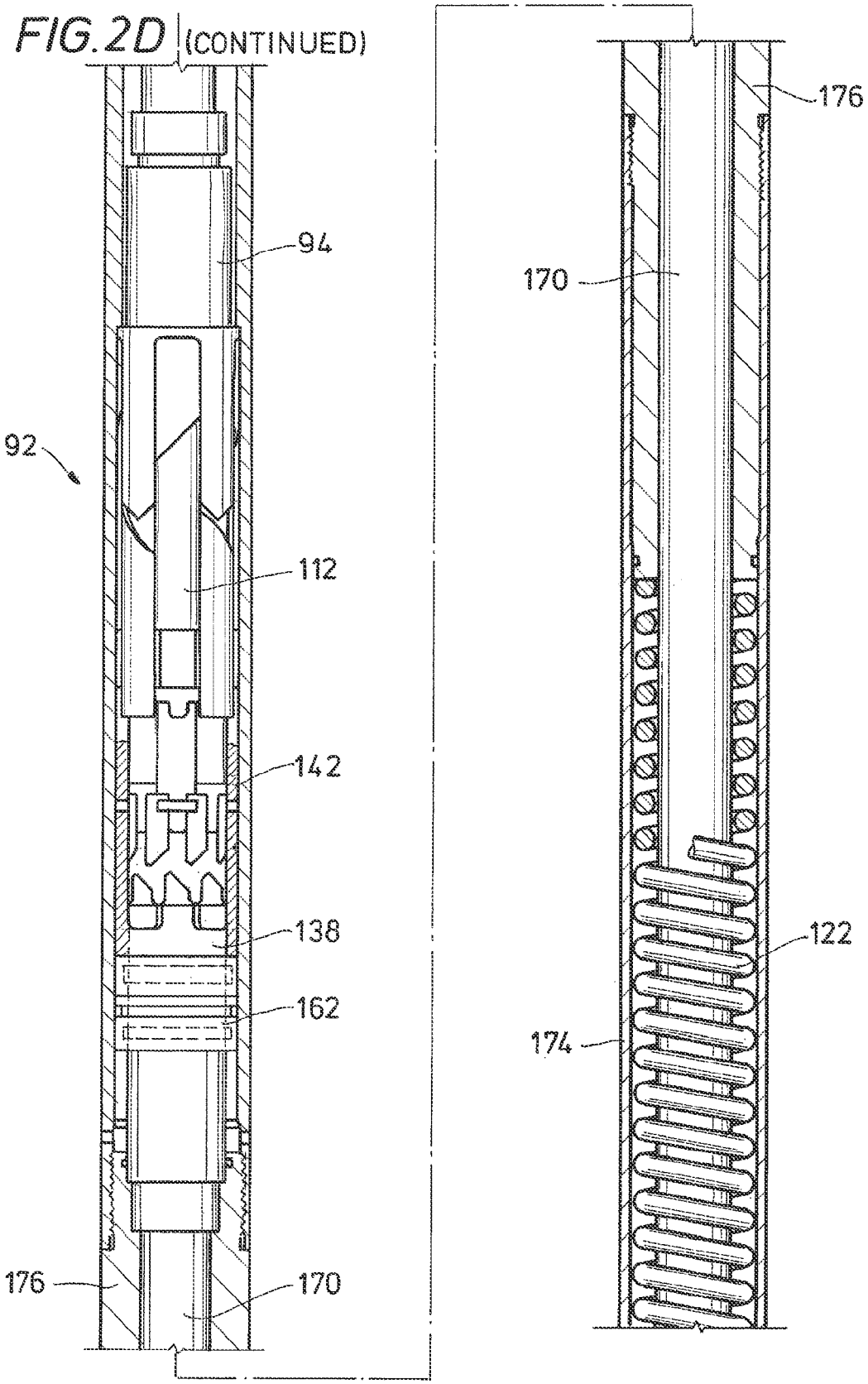
Figure 2D:
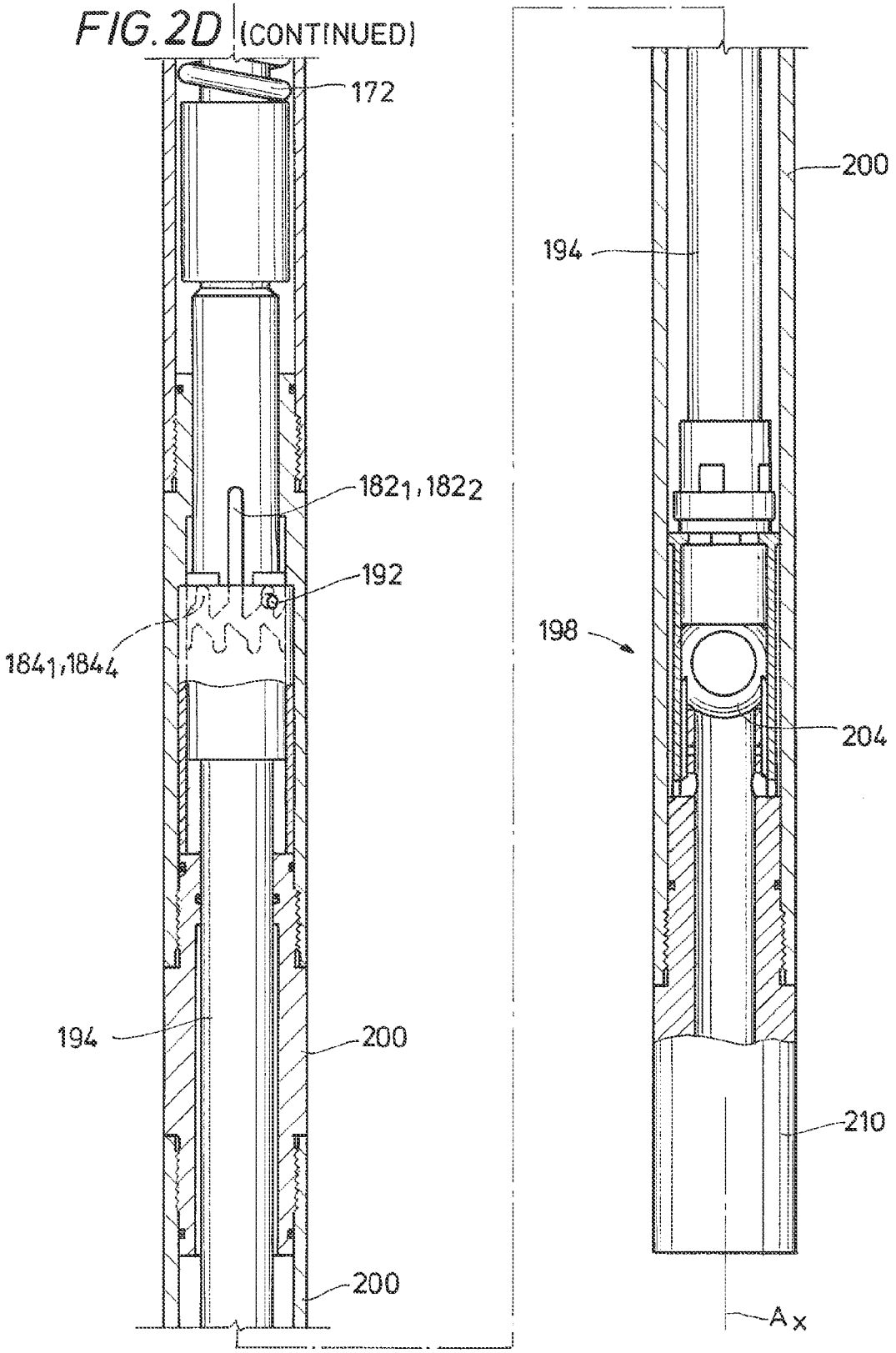

Referring now to FIG. 2D, pressure in the annulus space 21 has been reduced to a pressure designated as $P_3$, wherein pressure $P_3$ is less than pressure $P_4$ but greater than pressure $P_2$. The piston 162 moves into a corresponding third position, wherein the third position is axially between the fourth and second positions. Here, spring 172 has expanded to an intermediate position between that of FIGS. 2A and 2C as the pin 192 has indexed into a downward-facing slot $\mathbf{184}_1$, $\mathbf{184}_4$ adjacent to one of the elongate slots $\mathbf{182}_1$, $\mathbf{182}_2$. As the upper ends of downward-facing slots $\mathbf{184}_1$, $\mathbf{184}_4$ are lower than the terminal upper ends of $\mathbf{182}_1$, $\mathbf{182}_2$, spring mandrel 170 is prevented from retreating to its position of FIG. 2A. Thus, because selector member 138 is axially moveable with respect to spring mandrel 170, but ball valve selector 112 is connected to spring mandrel 170, the downward-facing shoulder 116 is axially offset from an upper end of arm 142 of selector member 138. However, the downward-facing shoulder 148 of arm 142 (FIG. 8) can contact the upward-facing shoulder 120 of ball valve selector 112 thereby restraining further downward movement.

Figure 2E:
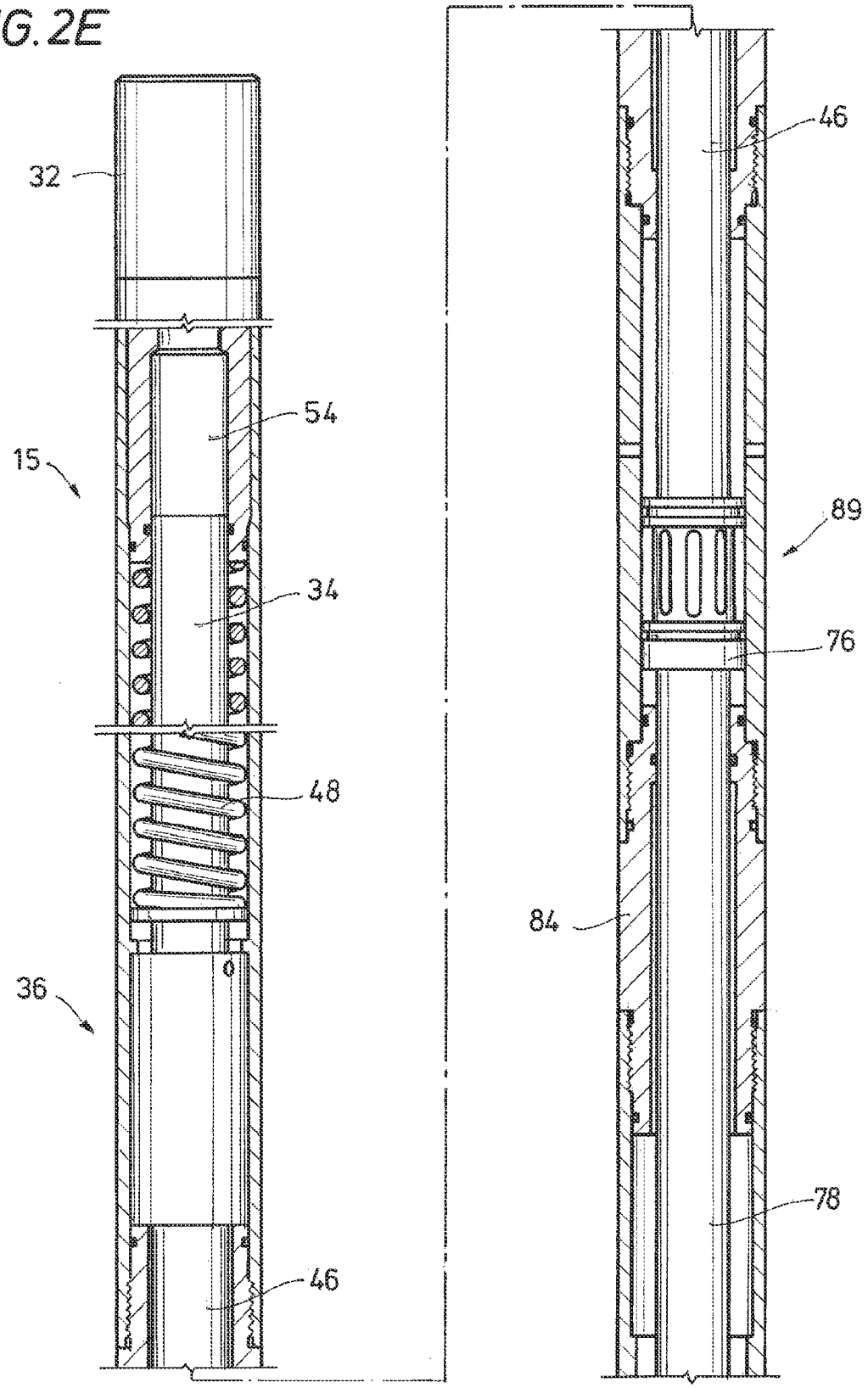
Figure 2E:
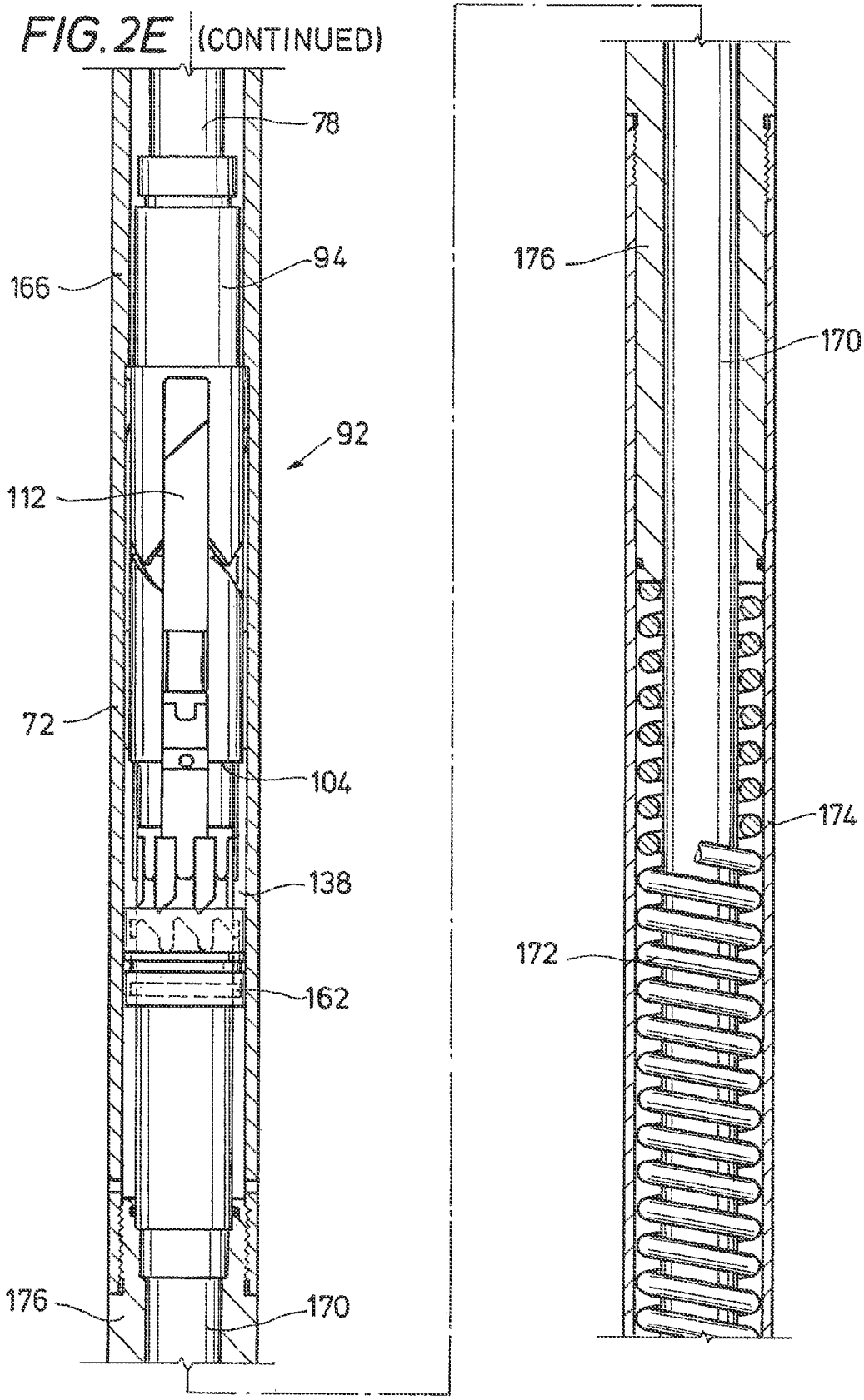
Figure 2E:
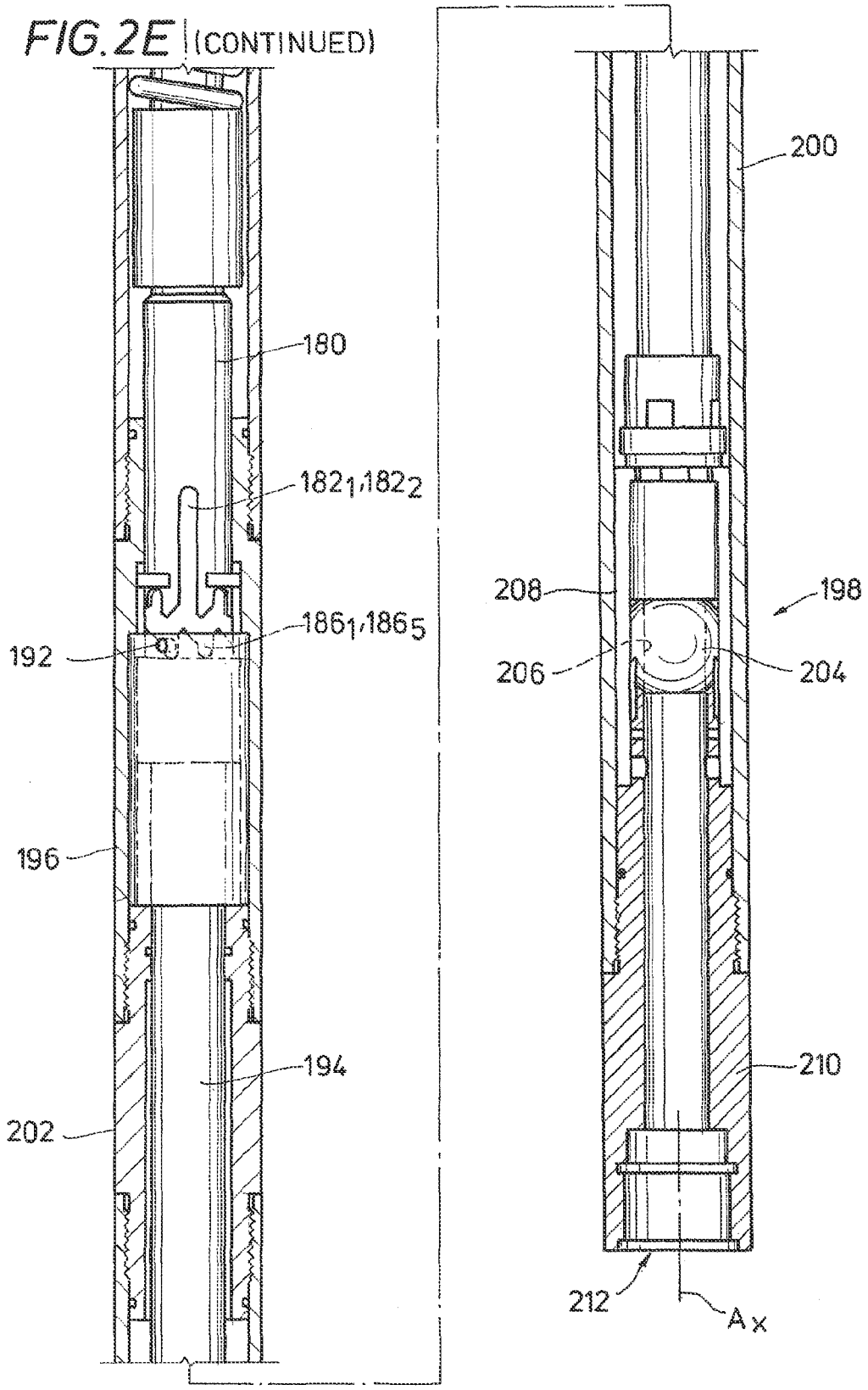

It should be pointed out that the slots $\mathbf{132}_1$-$\mathbf{132}_8$ (FIG. 4) are strategically oriented so that pin 146 engages these slots $\mathbf{132}_1$-$\mathbf{132}_8$ and thereby aligns the arms 142 of select member 138 respectively with fingers 98 of sleeve valve selector 94 or legs 114 of ball valve selector 112. Back and forth axial movement of selector member 138 guides pin 146 into adjacent one of the slots $\mathbf{132}_1\mathbf{432}_8$, thereby realigning the arms 142 with the fingers 98 or legs 114. More specifically, the castellated profiles $\mathbf{134}_1$-$\mathbf{134}_8$ and downward-facing surfaces of lands $\mathbf{130}_1$-$\mathbf{130}_8$ selectively move pin 146 therein to rotate selector member 138. Referring now to FIG. 2E, pressure in the annulus space 21 is increased to that of about $P_4$ thereby moving piston 162 and selector member 138 axially upward to again move ball valve selector 112 upward and pull the spring mandrel 170 and indexing mandrel 180 upward as well. This re-indexes pin 192 into one of upward-facing slots $\mathbf{186}_5$, $\mathbf{186}_8$ which is (when looking downward) clockwise of an elongate slot $\mathbf{182}_1$, $\mathbf{182}_2$. As discussed above, the helically-shaped upward and lower facing surfaces of the profiles $\mathbf{188}_1$-$\mathbf{188}_8$, $\mathbf{190}_1$-$\mathbf{190}_8$ guide the pin 192 into adjacent one of the slots provided on the indexing mandrel 180. It should be noted that in the configuration of FIG. 2E, the ball valve assembly 198 remains in its open position and the sleeve assembly 89 remains in a closed position thereby isolating the formation space 20 from annulus space 21 (FIG. 1).

Figure 2F:
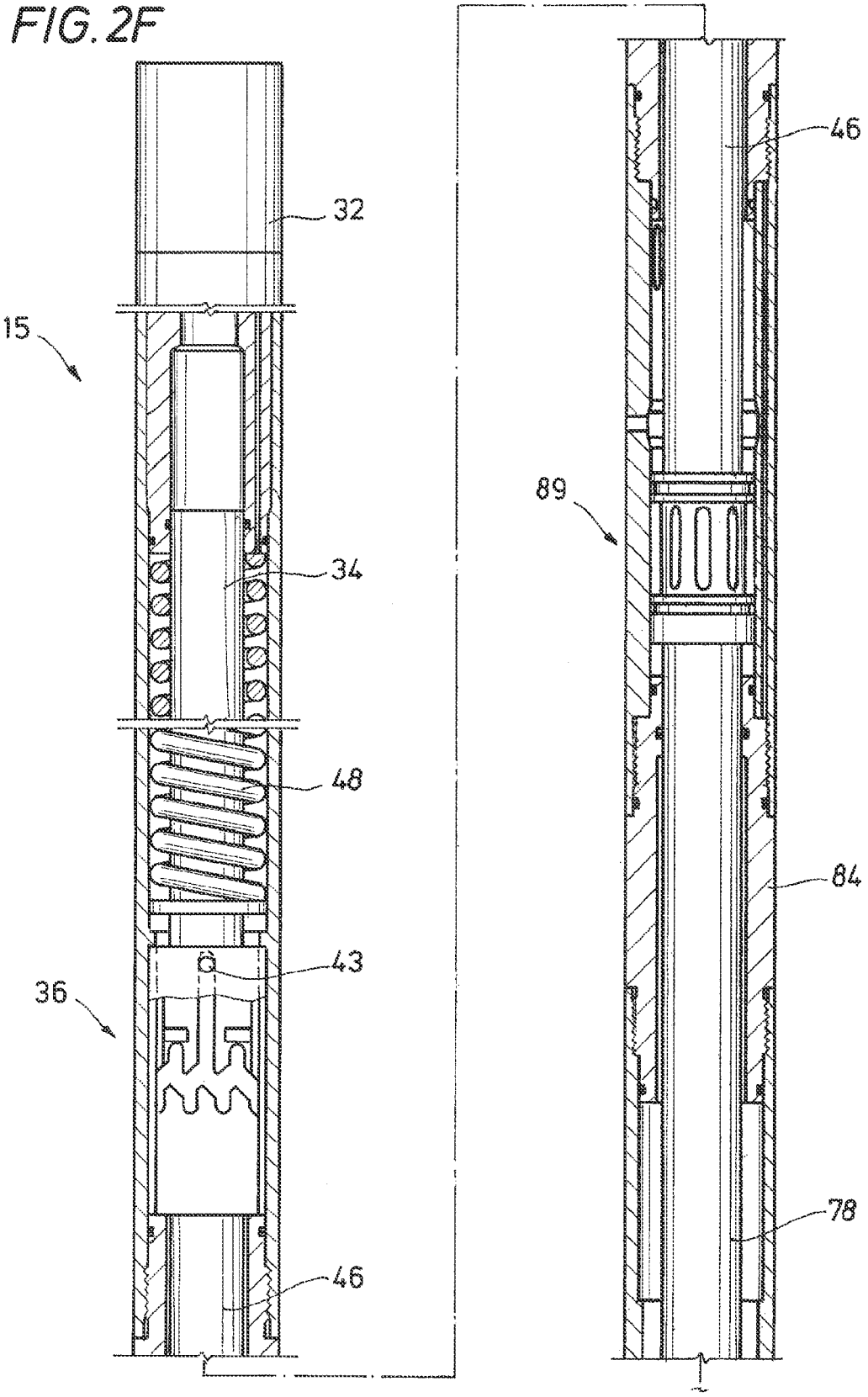
Figure 2F:
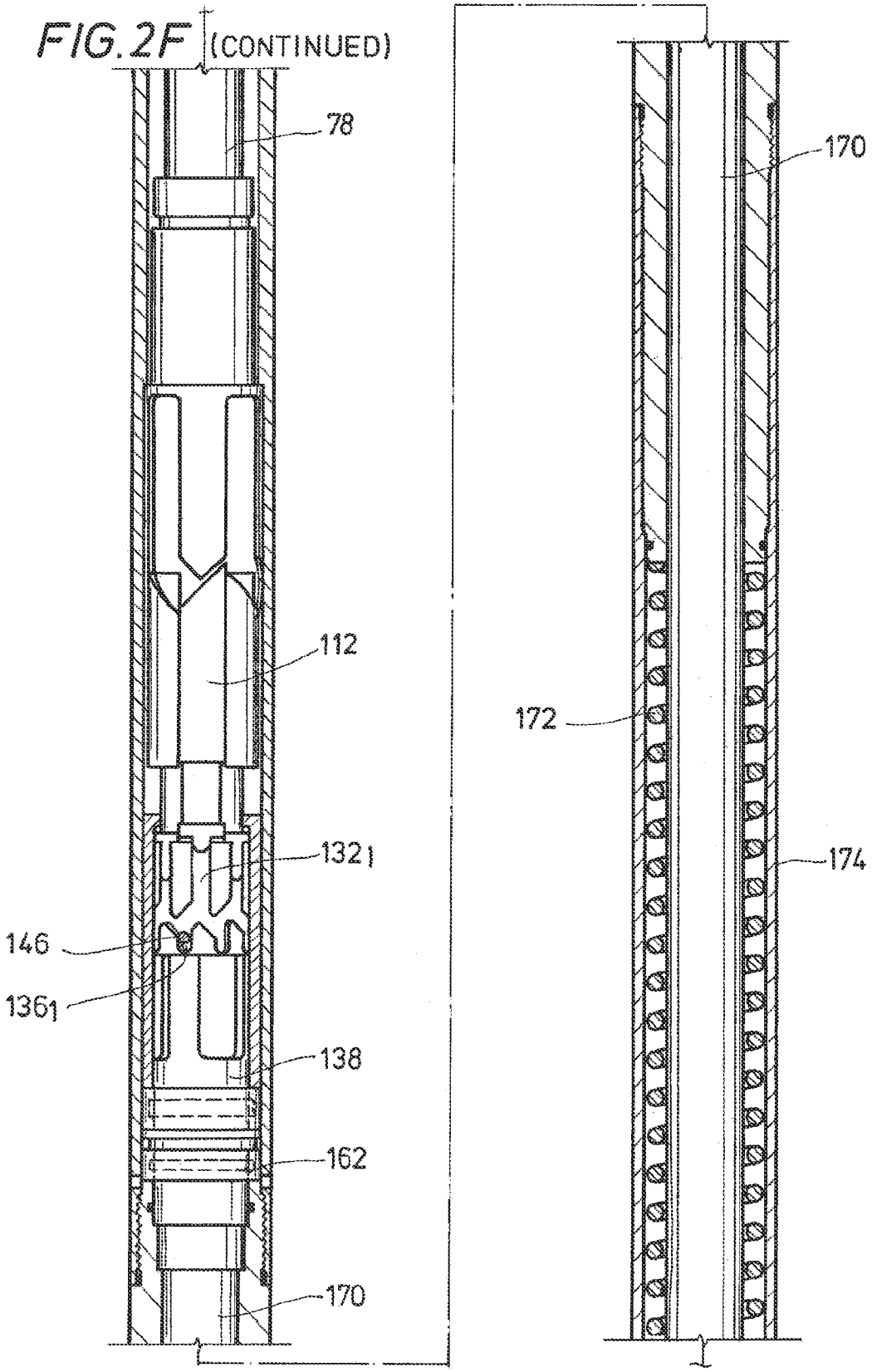
Figure 2F:
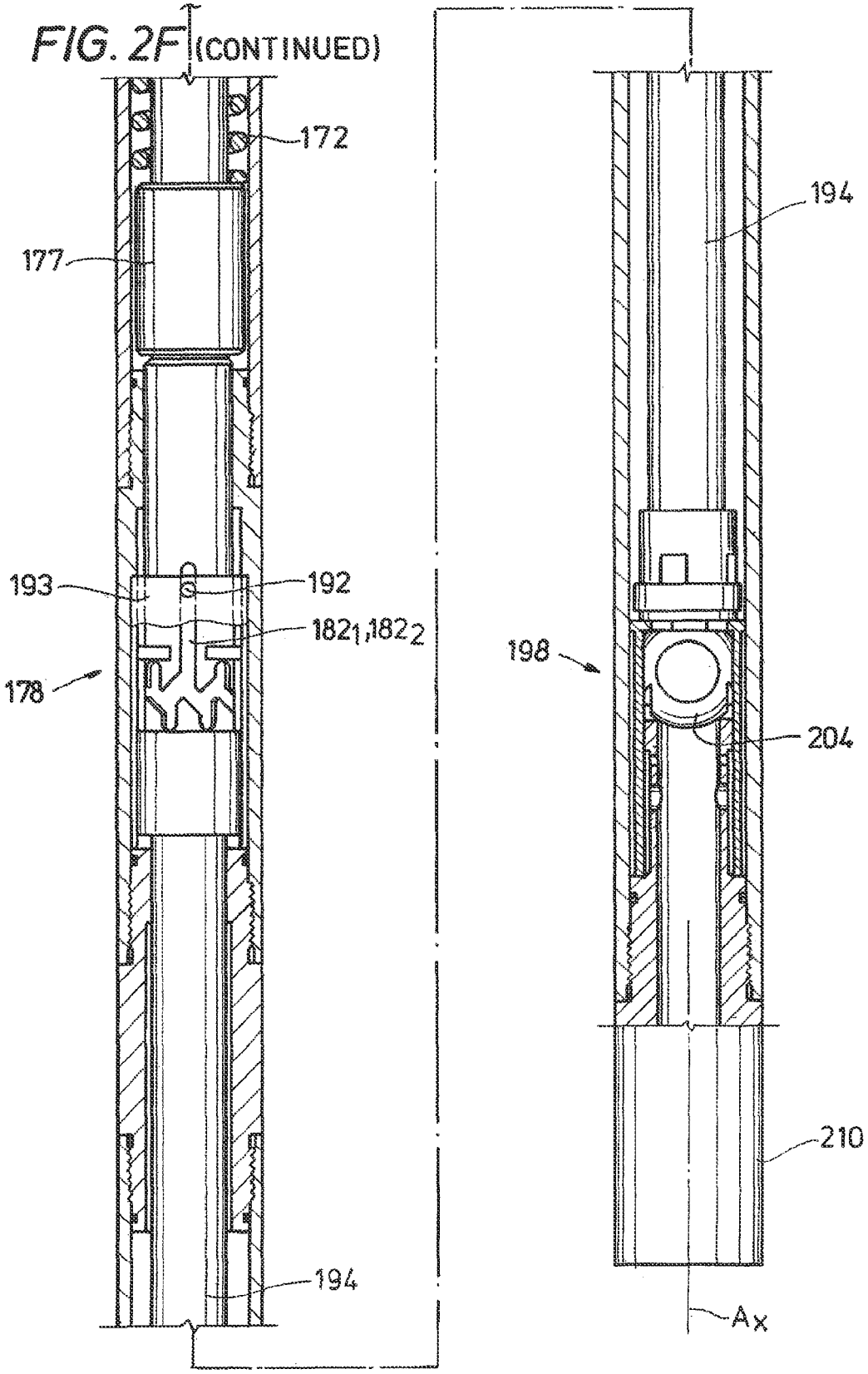

In FIG. 2F, pressure in the annulus space 21 has been reduced to about that of pressure $P_1$ thereby allowing piston 162 to move axially downward and proximate to its first position as shown in FIG. 2A. This in turn allows pin 146 to index from one of the elongate slots (represented in FIG. 2F as slot $\mathbf{132}_1$) into an adjacent upward-facing slot (represented in FIG. 2F as $\mathbf{136}_1$). As the upward force onto the ball valve selector 112 from the selector member 138 has been removed, pin 192 is allowed to enter one of the elongate downward-facing slots $\mathbf{182}_1$, $\mathbf{182}_2$ that in turn allows the spring mandrel 170 and ball valve mandrel 194 to drop axially downward thereby putting ball valve assembly 198 into a closed position.

Figure 2G:
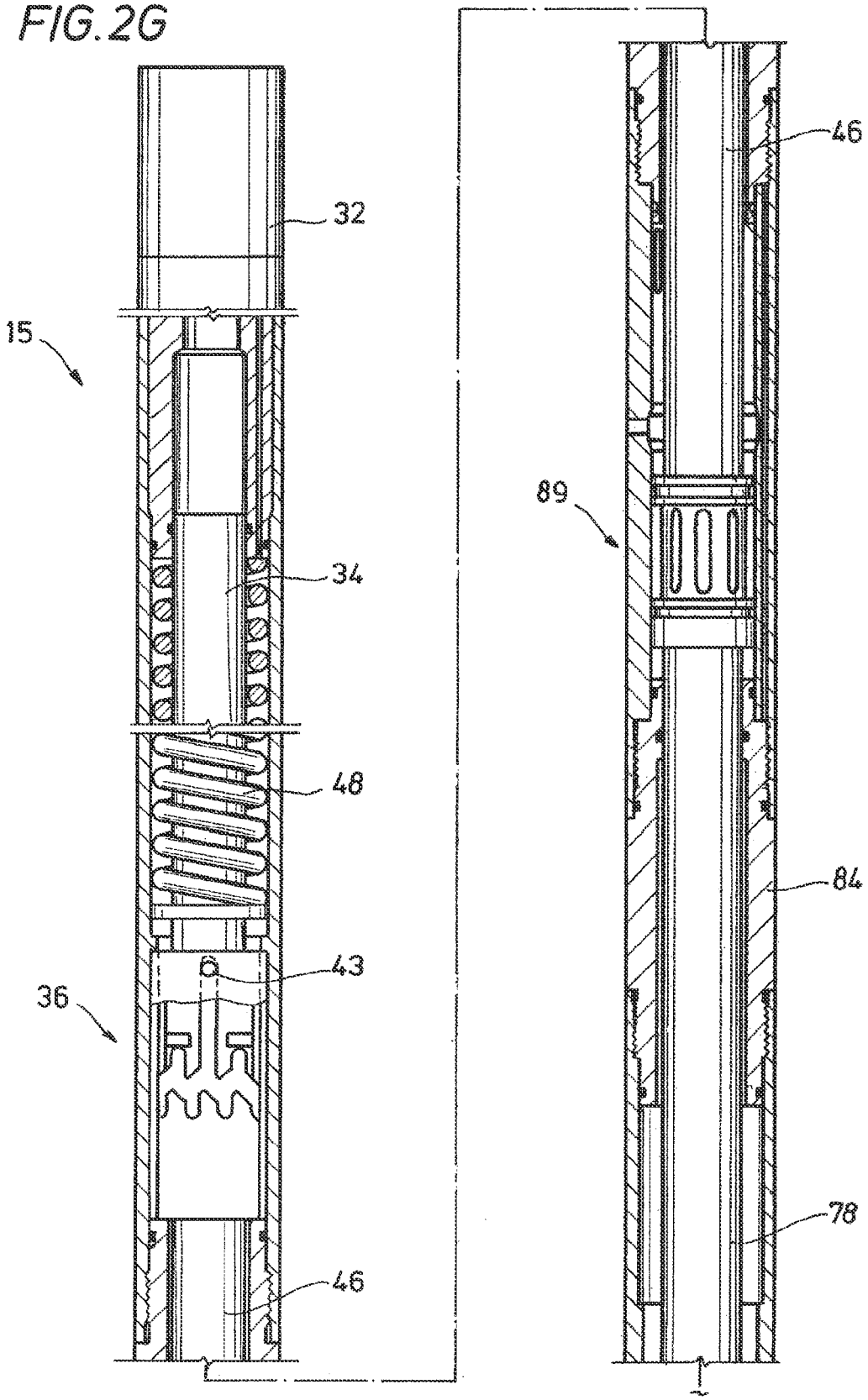
Figure 2G:
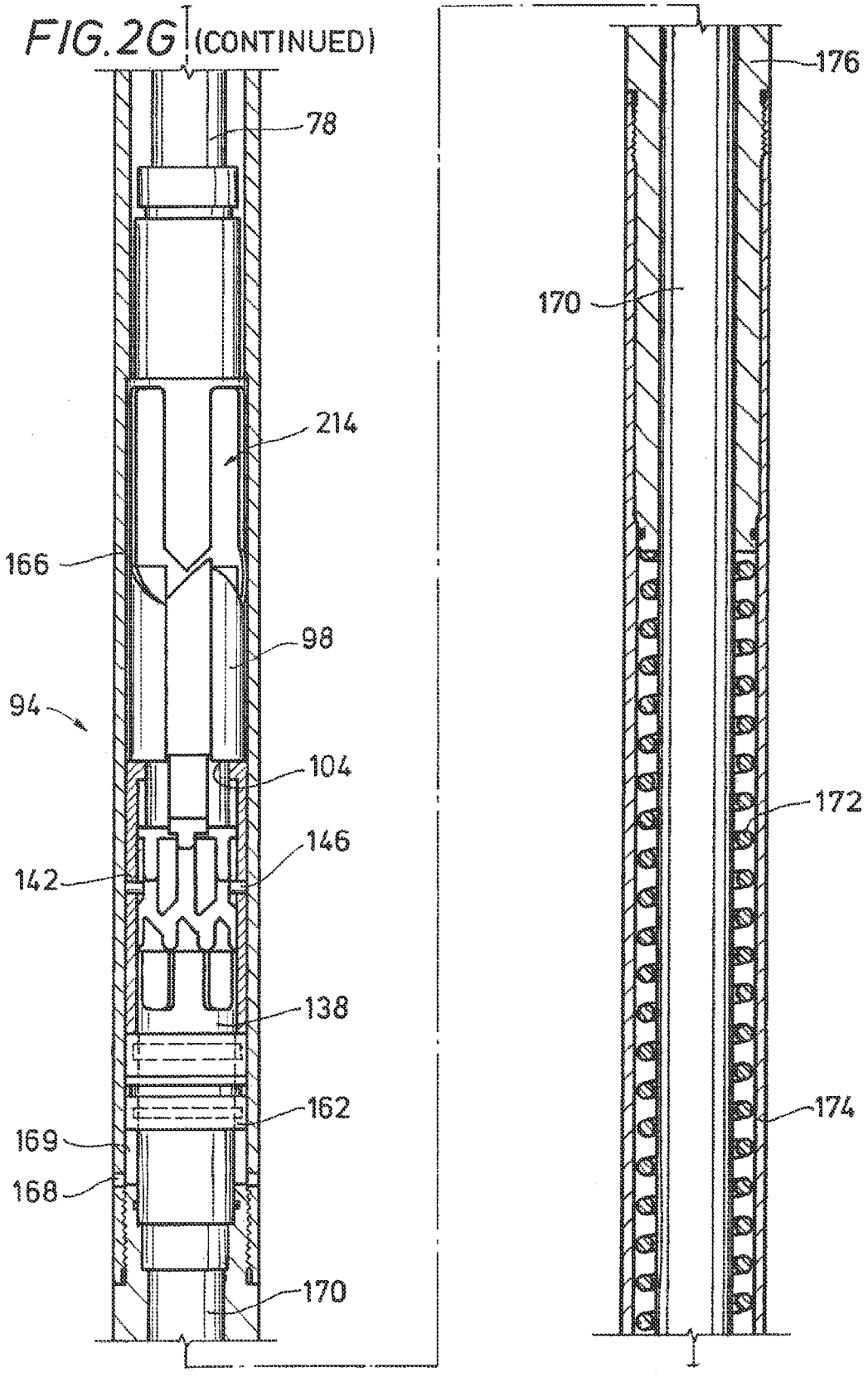
Figure 2G:
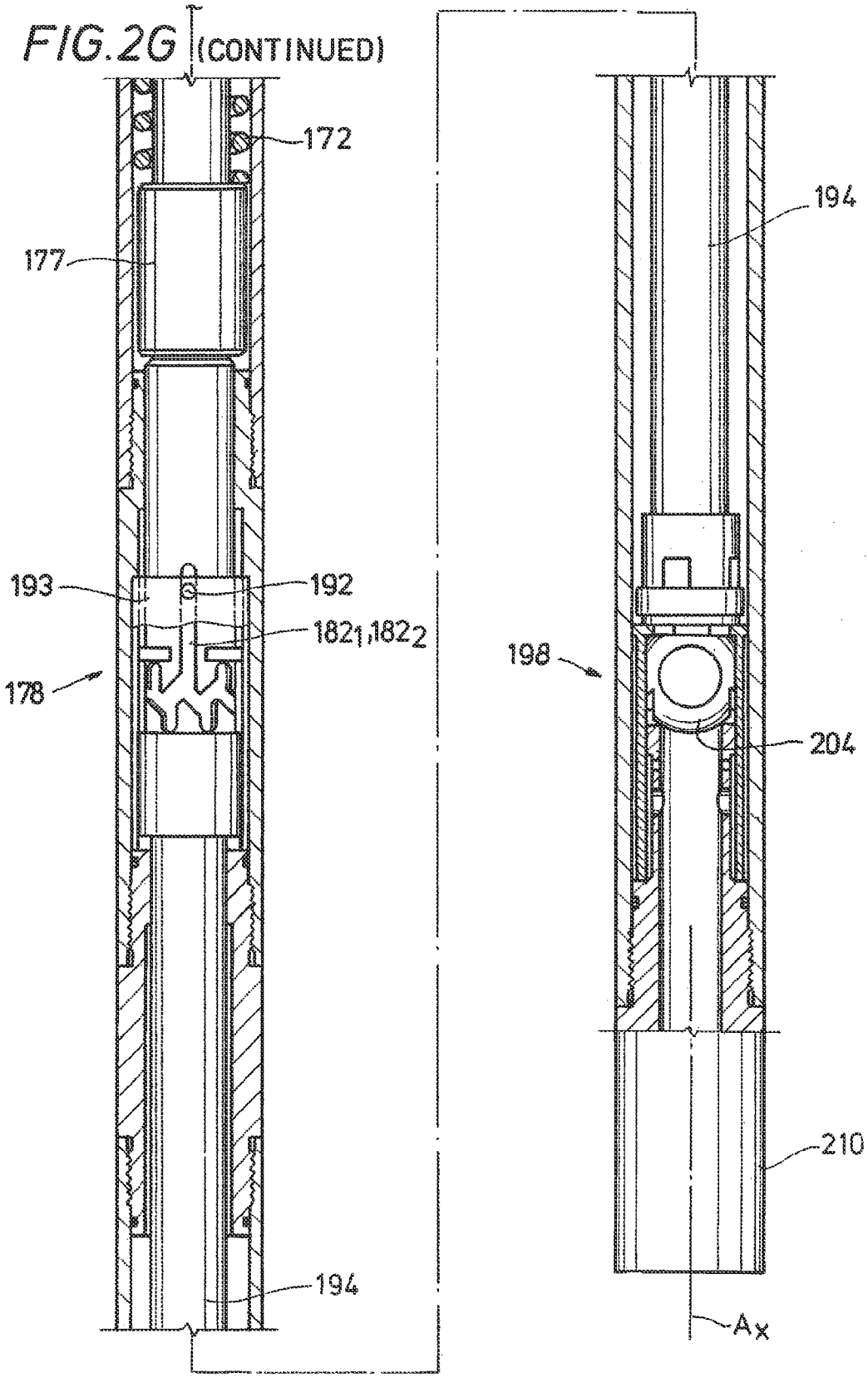

The operations described in FIGS. 2A through 2F have positioned the selector member, as shown in FIG. 2G, such that additional upward axial movement of selector member 138 causes pin 146 to enter a slot $\mathbf{132}_1$-$\mathbf{132}_8$ (FIG. 7) that will in turn align arm 142 with one of the fingers 198 from the sleeve valve selector 94. As illustrated in FIG. 2G, pressure in the annular space 21 is pressurized to a pressure of about $P_2$ thereby moving piston 162 to its second position and thus upwardly moving selector member 138 to a position so that the upper ends of its arms 142 are in contact with downward-facing shoulders 104 on the sleeve valve selector 94.

Figure 2H:
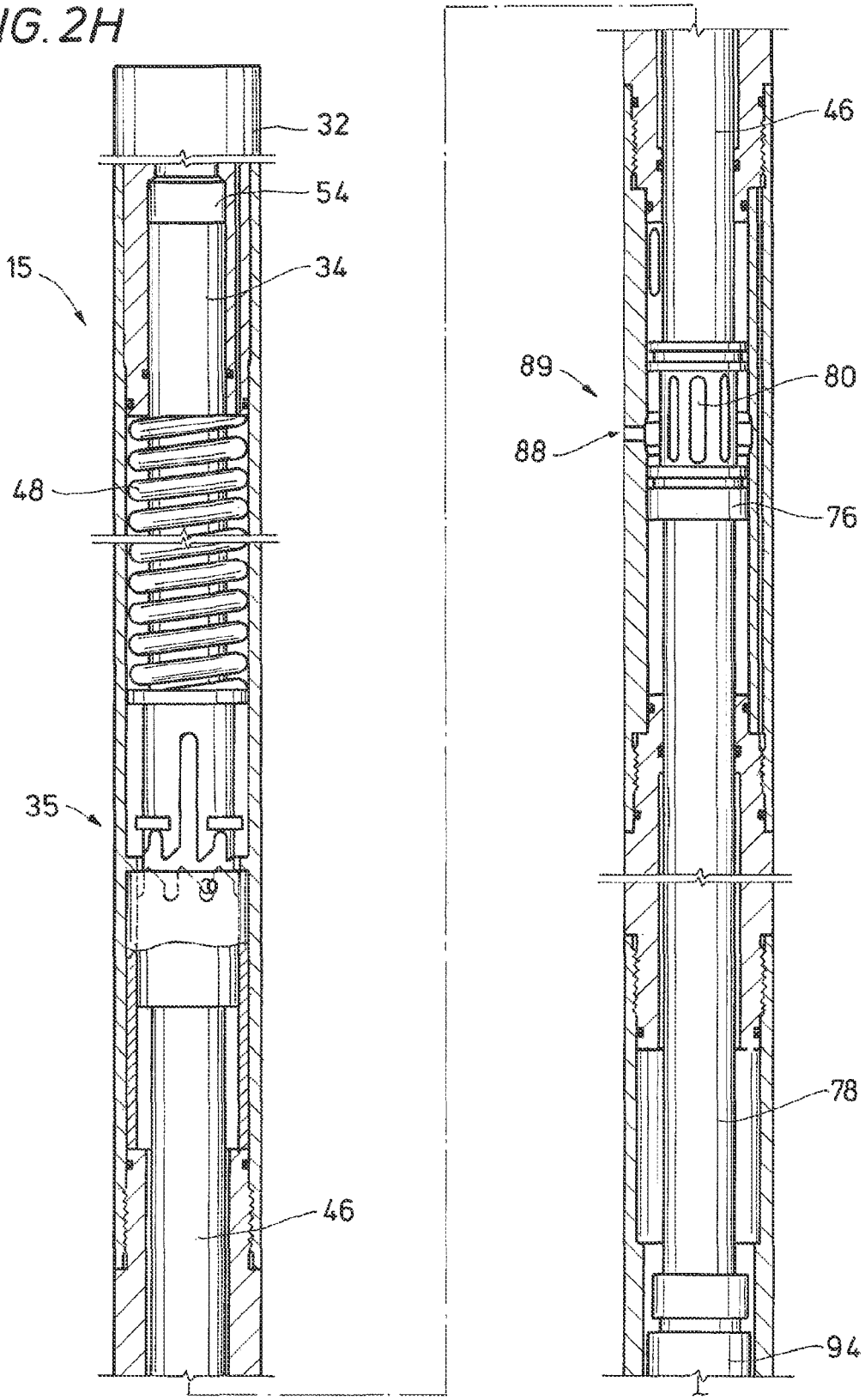
Figure 2H:
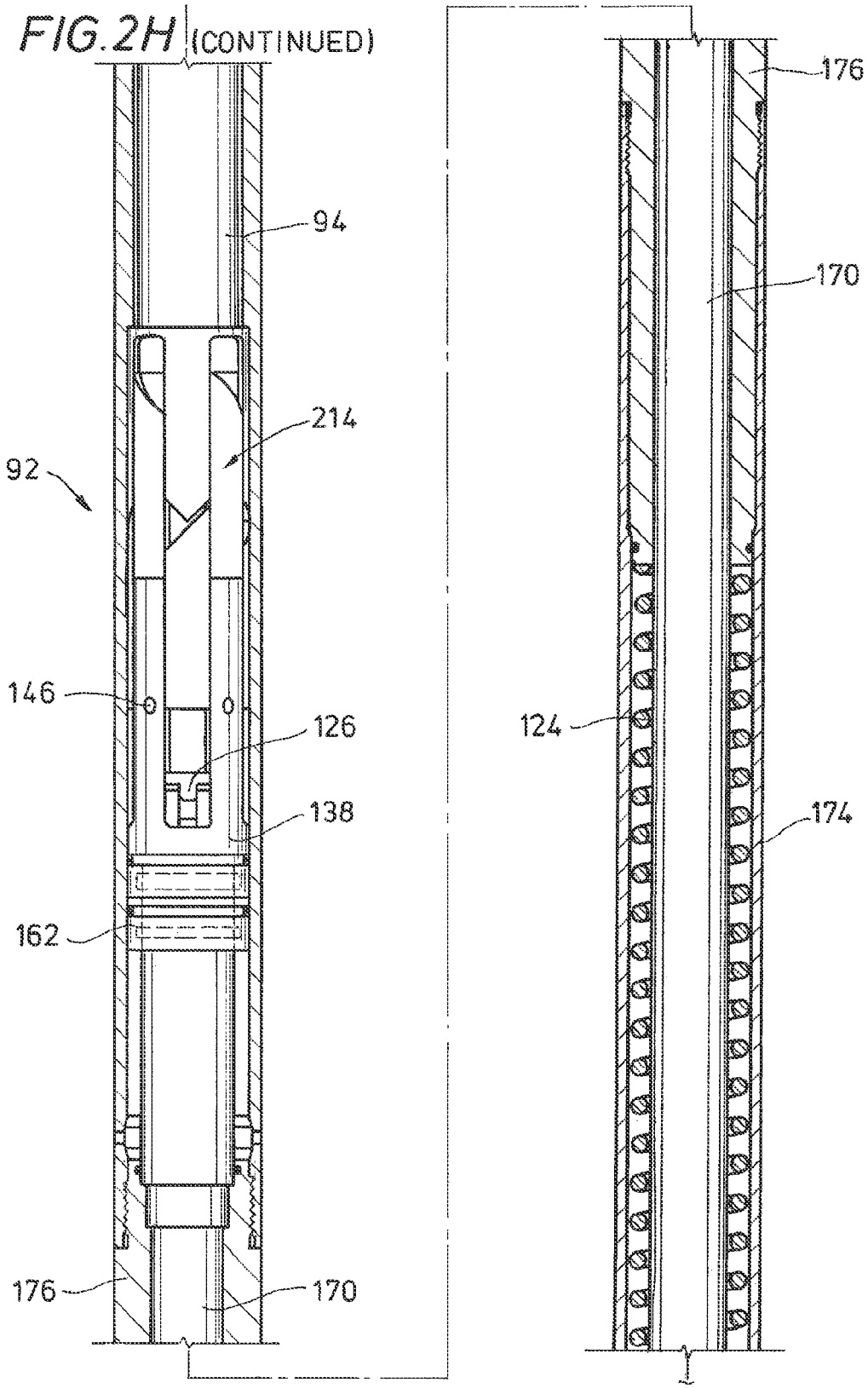
Figure 2H:
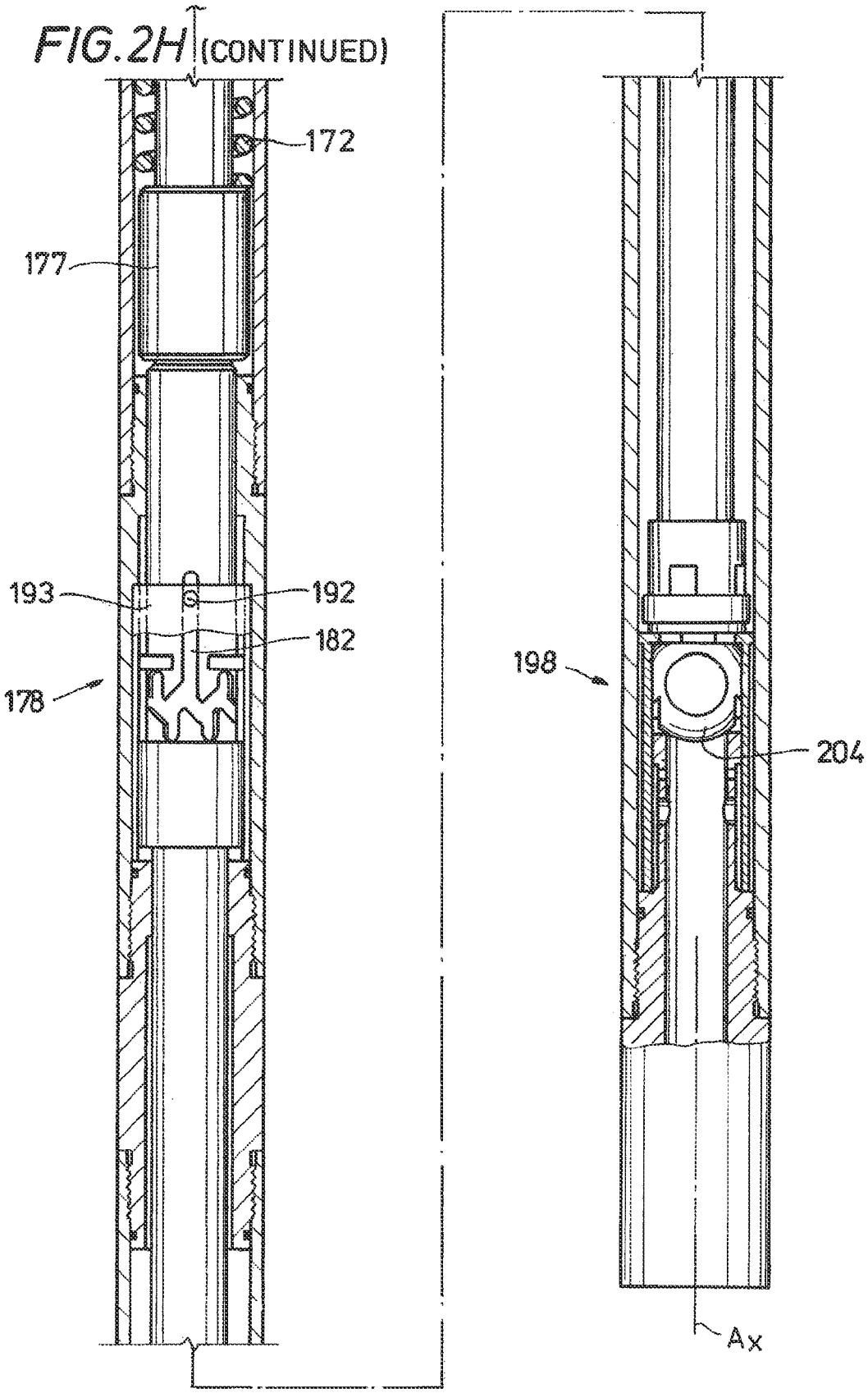

Referring now to FIG. 2H, the pressure in the annulus space 21 is increased to a pressure of about that of P4 that in turn upwardly drives piston 128 and selector member 138 to axially urge the sleeve valve selector 94 upward. As sleeve valve selector 94 is mechanically coupled with lower sleeve valve mandrel 78, the lower sleeve valve mandrel 78 moves axially upwards to in turn upwardly urge sleeve valve assembly 89. In this configuration, the slots 80 in the sleeve valve 76 are positioned adjacent to port 88. As such, the axial passage within upper sleeve valve mandrel 46 and spring valve mandrel 34 is in communication with the annulus space 21 (FIG. 1) via port 88. In this configuration, recirculation through the tubing 22 (FIG. 1) and tool 15 into the annular space 21 may take place due to registration of the slots 80 with port 88—thus sleeve valve assembly 89 can be referred to as an annulus valve. It should be pointed out that the strategic orientation of the slots on the shifter assembly 92 prohibits opening of the ball valve assembly 198 the same time as the sleeve valve assembly 89. Further, as discussed above with regard to FIG. 3, an amount of nitrogen provided by the nitrogen charge assembly 58 can serve to return the shifter assembly 92 to its configuration of FIG. 2A by reducing pressure in the annular space 21. Further shown in FIG. 2H is the spring mandrel 34 moved upward and inserted into the cavity 54 of the crossover sub 32, thereby compressing spring 48.

Figure 2I:
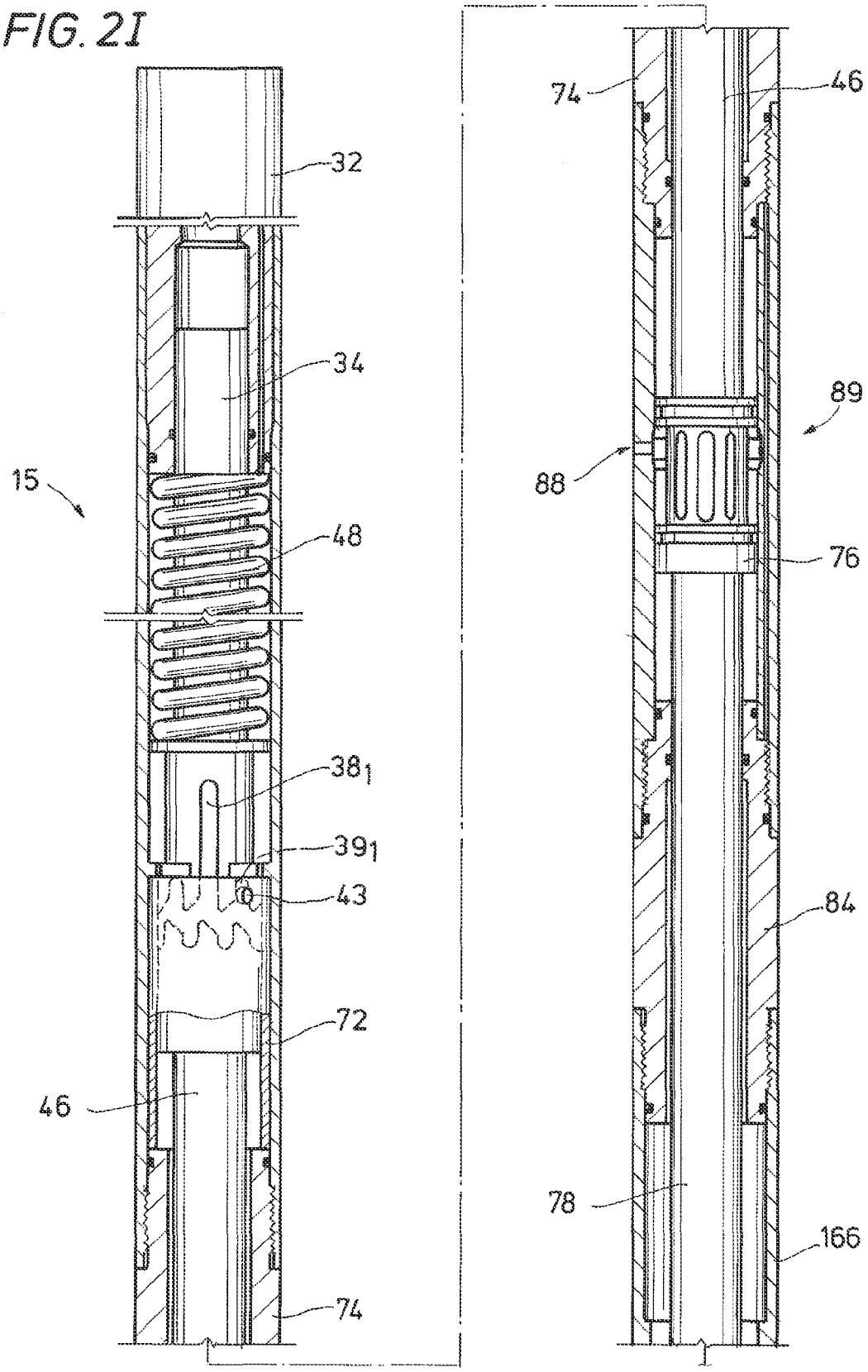
Figure 21:
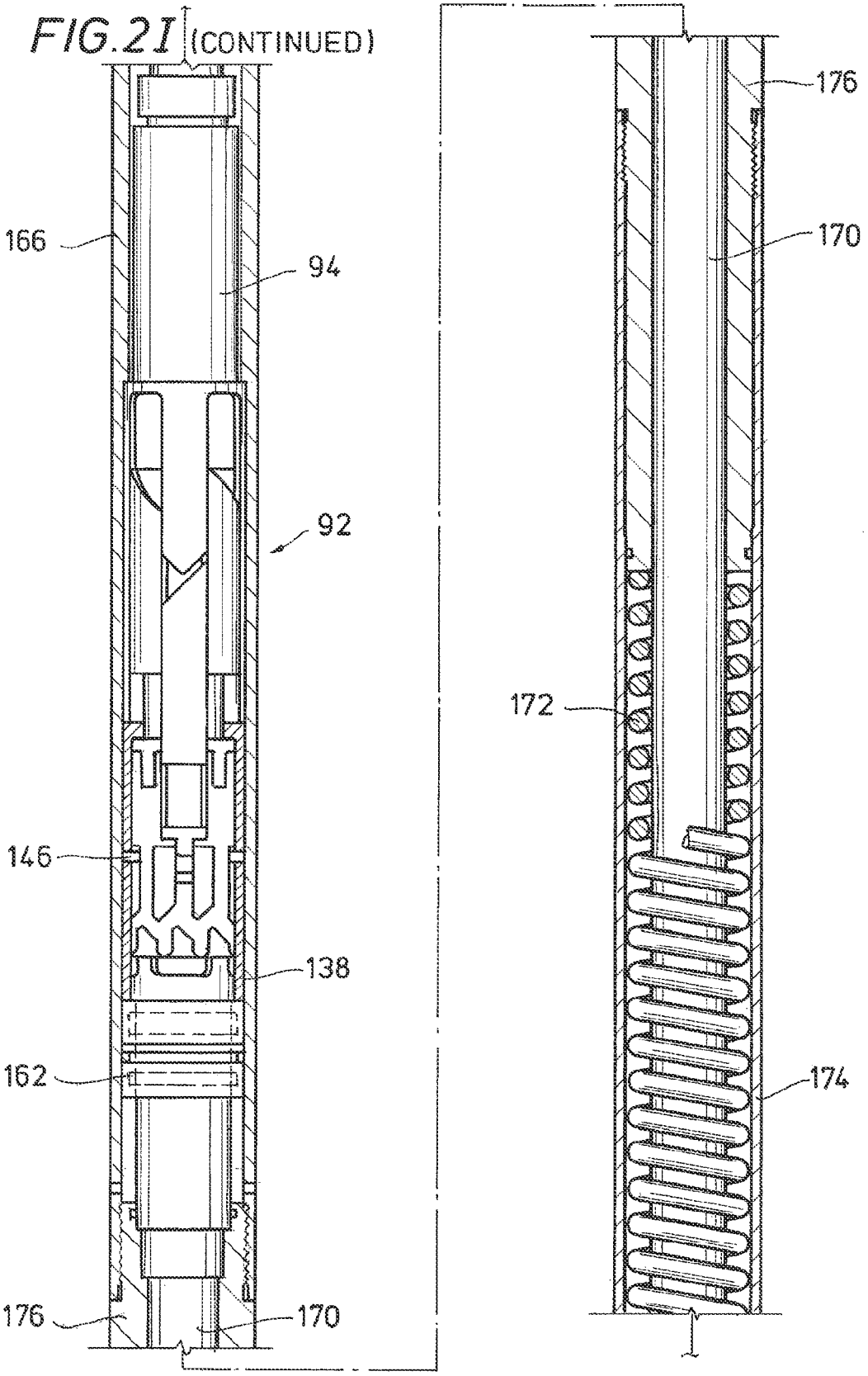
Figure 2I:
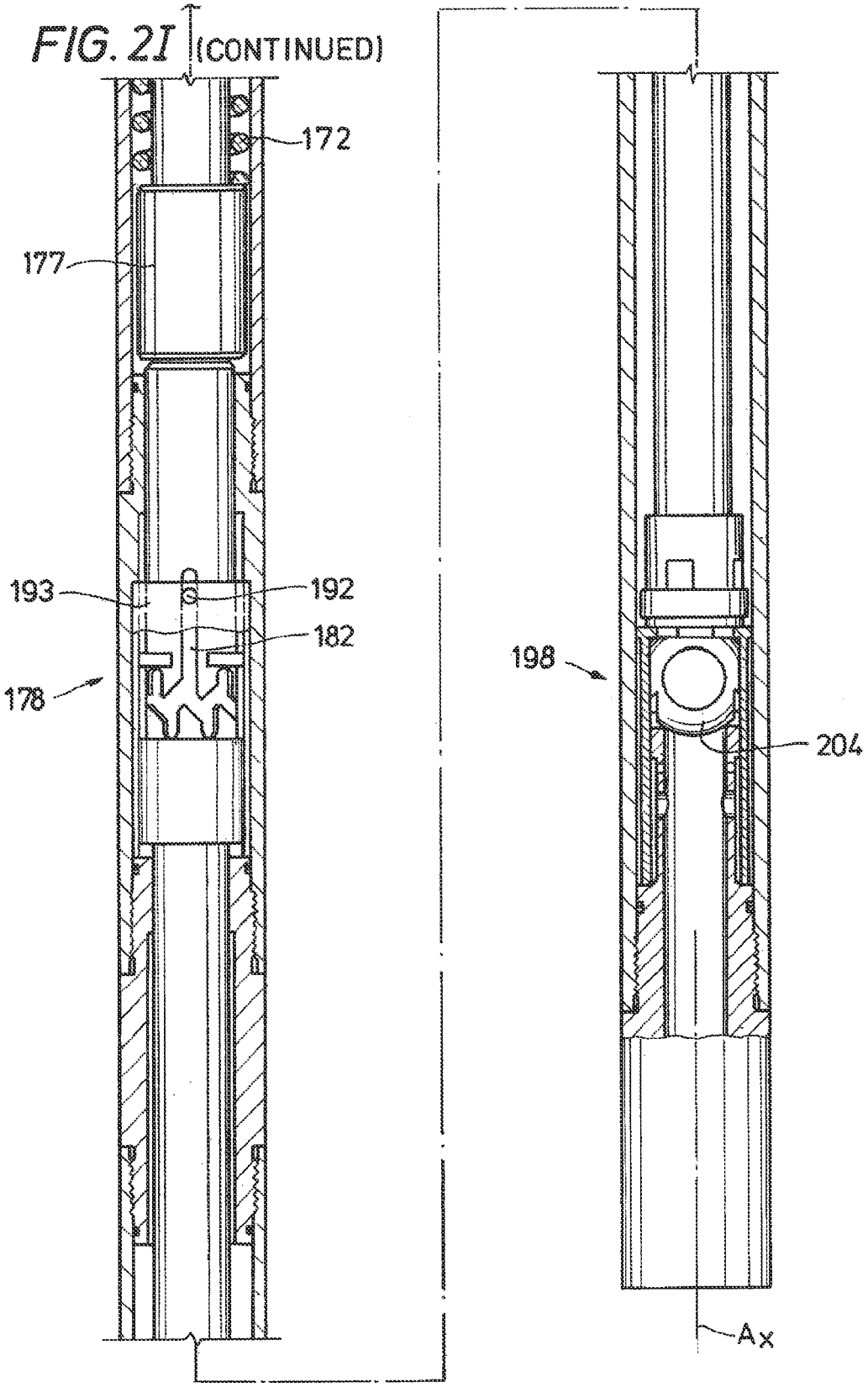
Figure 2J:
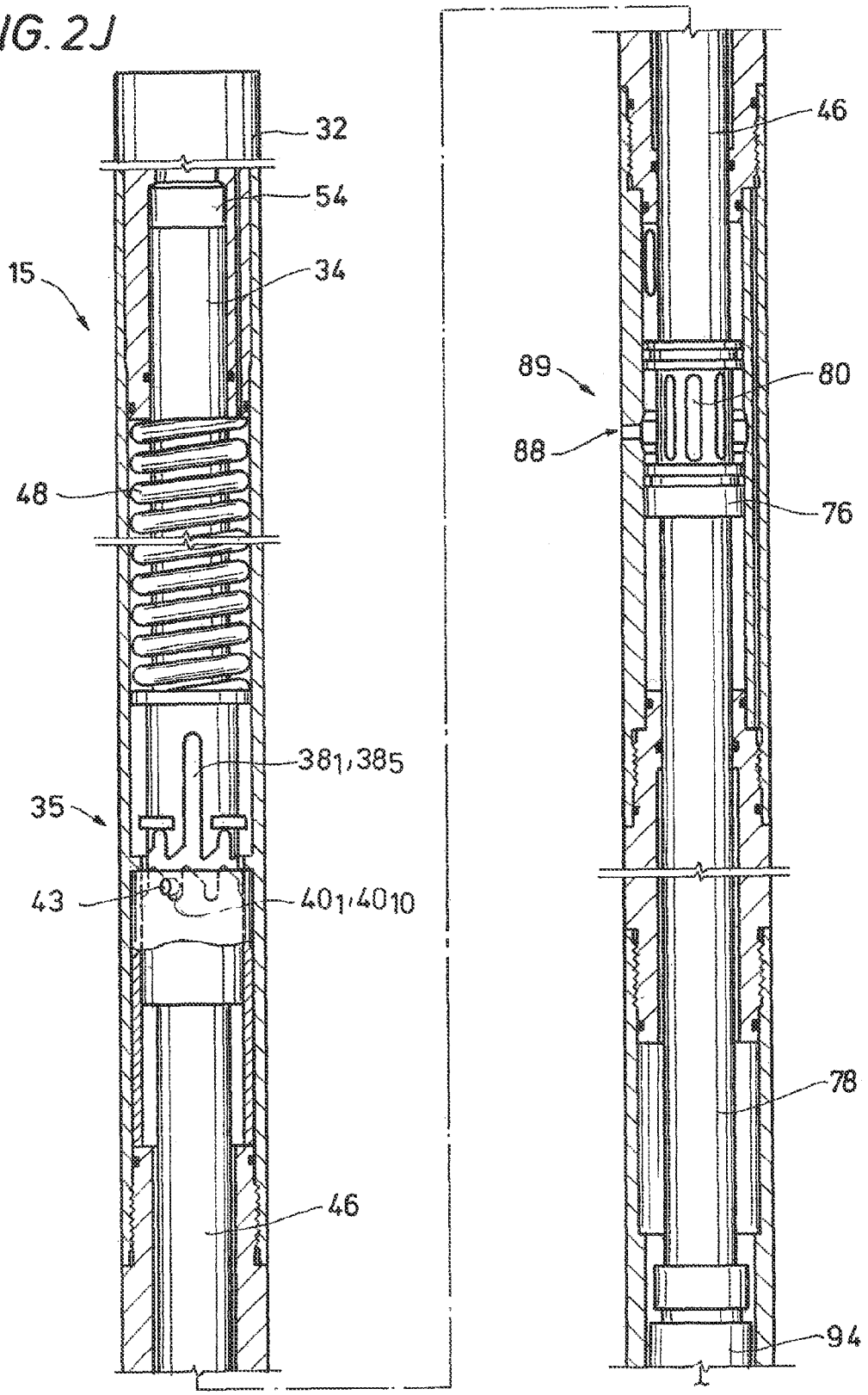
Figure 2J:
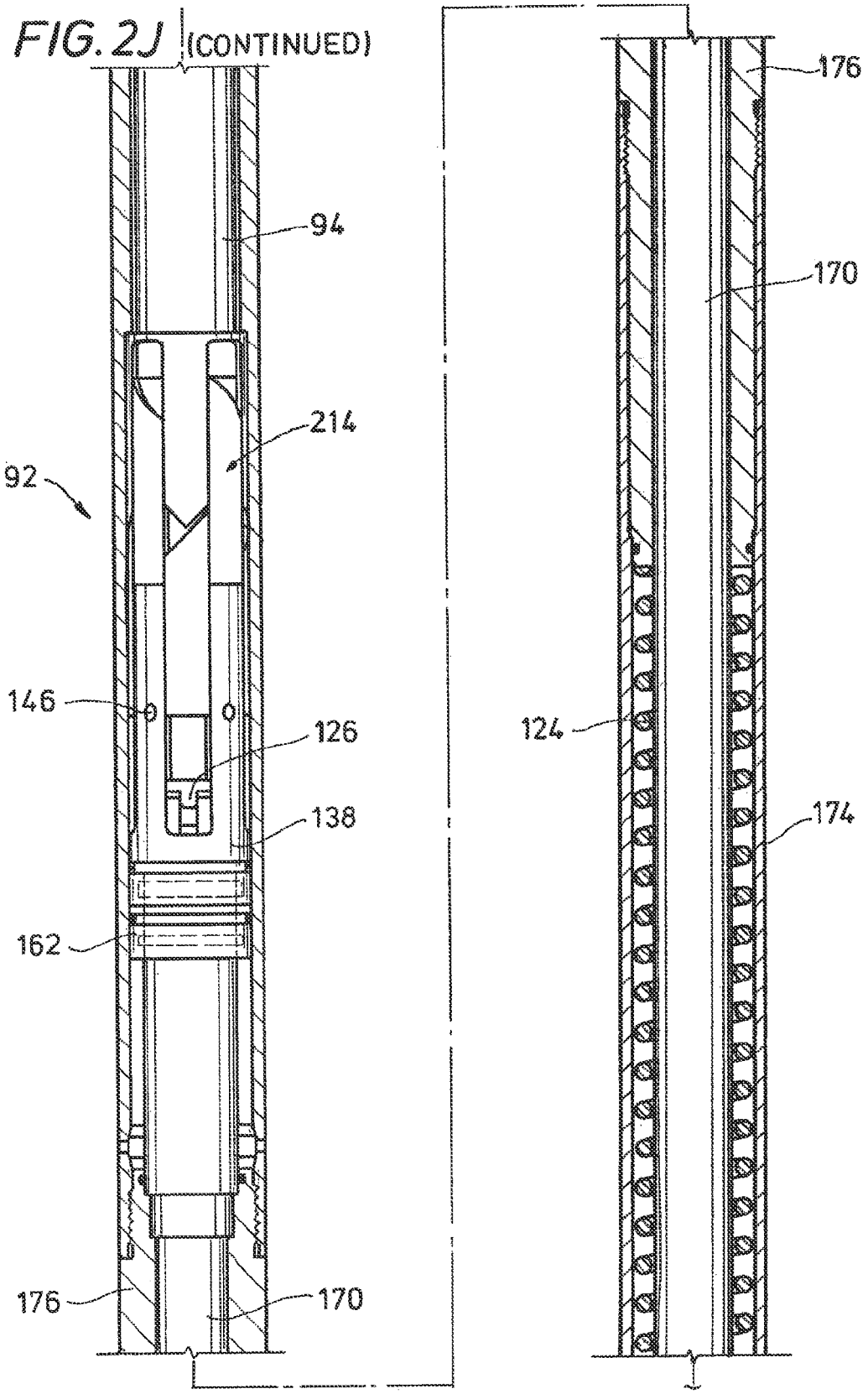
Figure 2J:
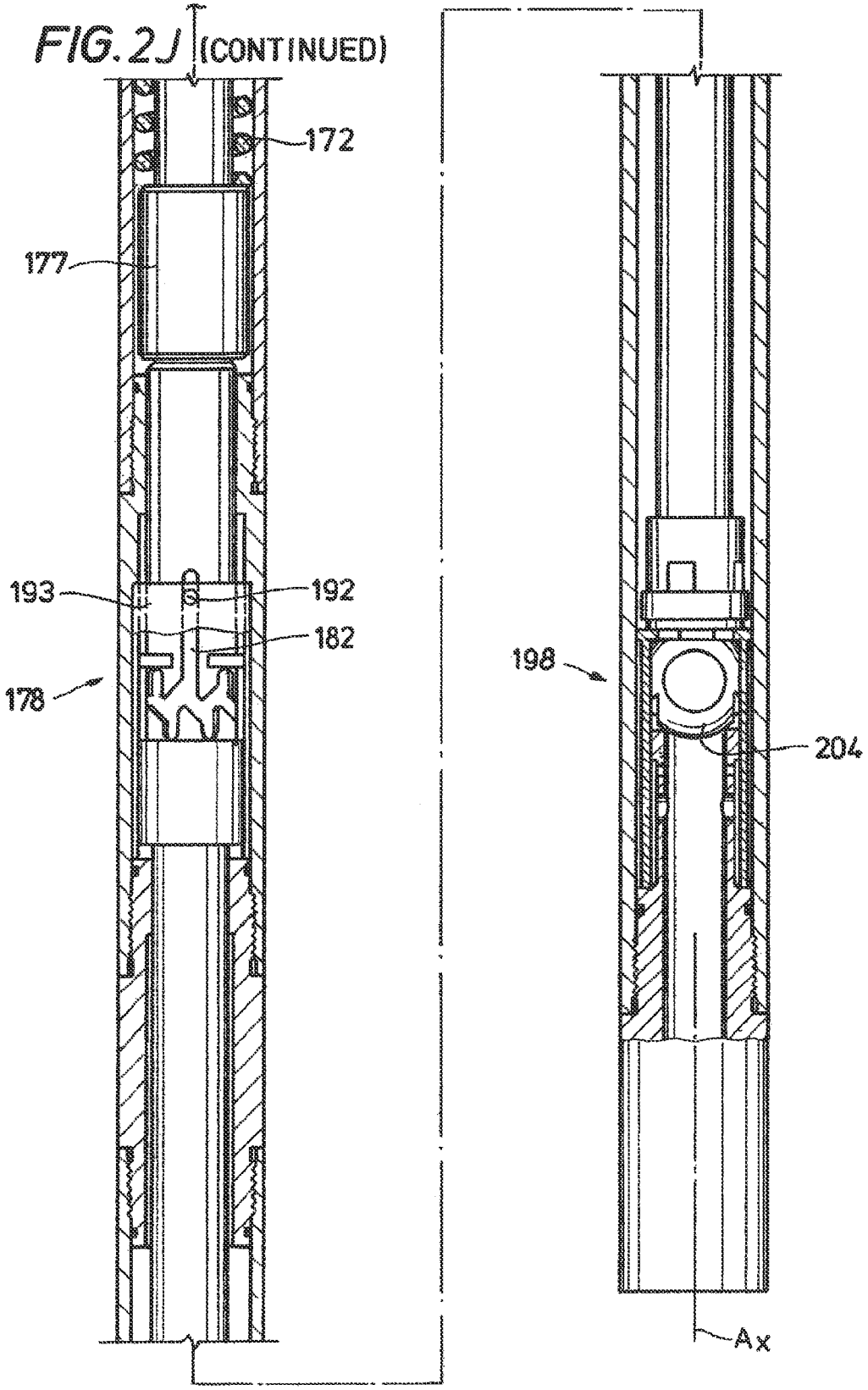
Figure 2K:
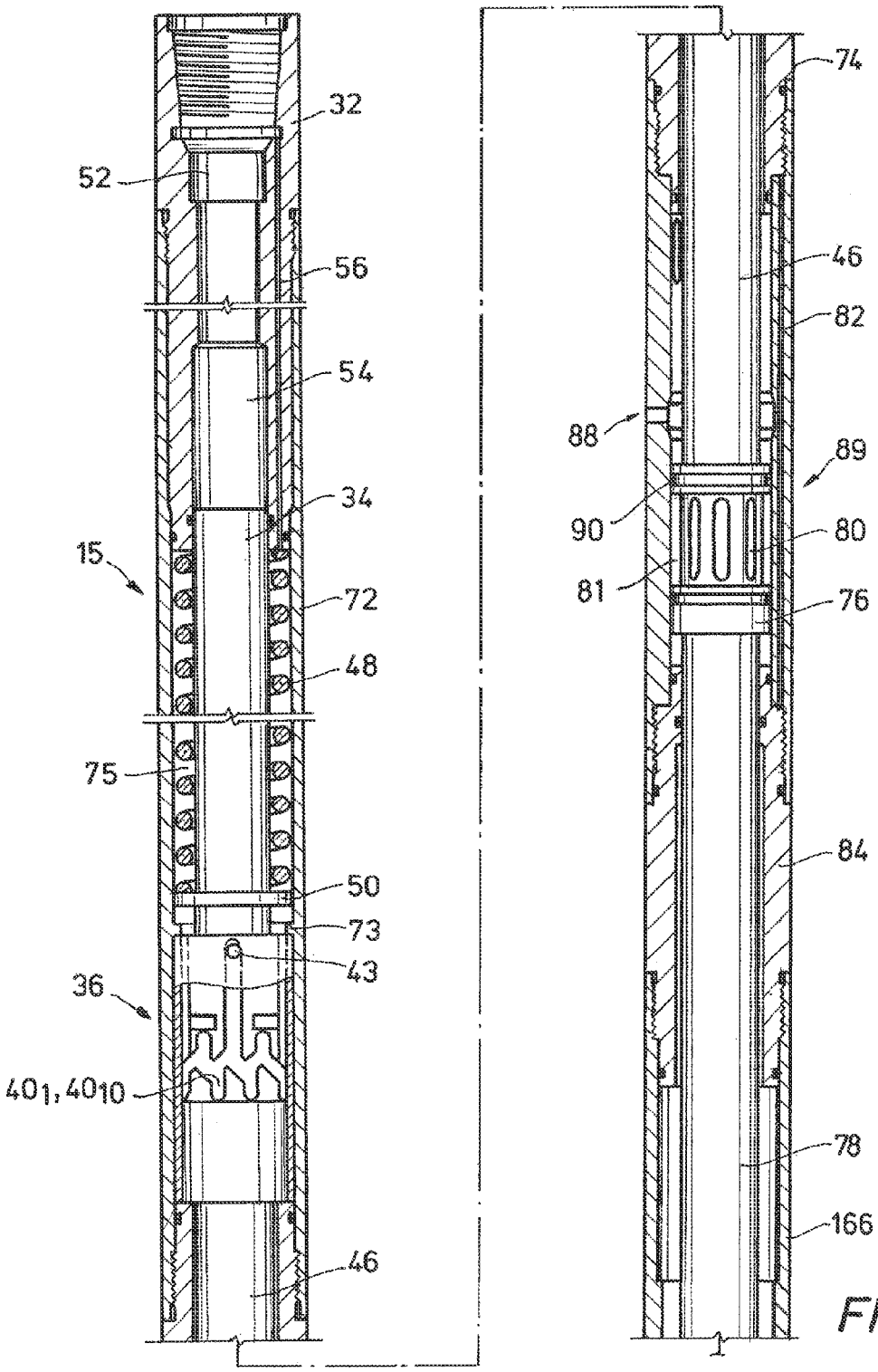
Figure 2K:
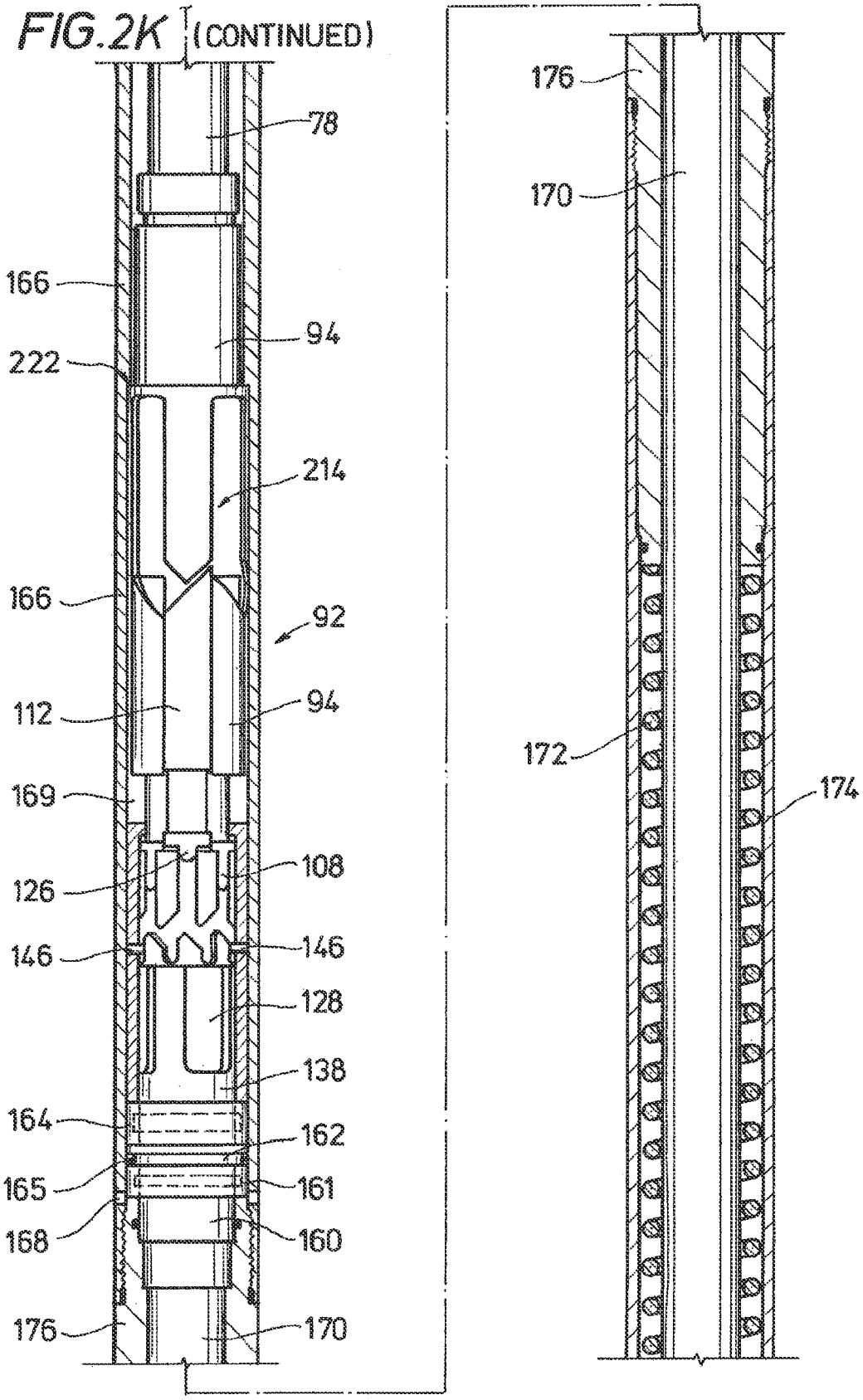
Figure 2K:
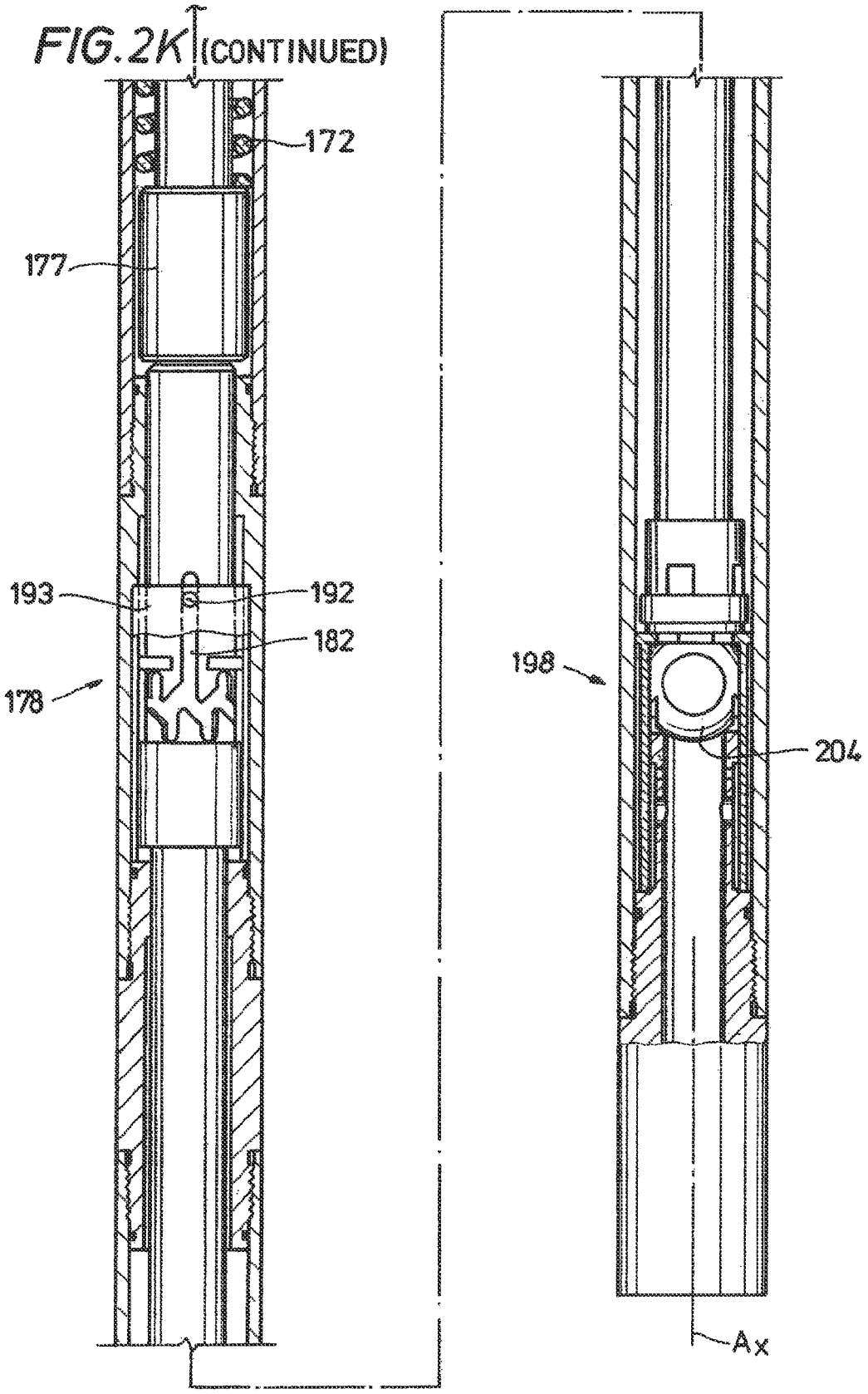

As shown in FIG. 2I, pressure in annulus space 21 is reduced to a pressure of about that of $P_3$ and so that piston 162 is moved axially downward into its third position. The movement of the piston 162 allows downward movement of selector member 138, however, the axial reciprocation of the spring mandrel 34 has relocated pin 43 from one of the elongate downward-facing slots $\mathbf{38}_1$-$\mathbf{38}_5$ (represented in FIG. 2I as $\mathbf{38}_1$) and into an adjacent shorter downward-facing slot $\mathbf{39}_1$-$\mathbf{39}_5$ (illustrated in FIG. 2I as $\mathbf{39}_1$). As the indexing collar 42 is retained within upper housing by the connector sub 74, the connections between mandrel 34, mandrel 46, mandrel 78 and sleeve valve selector 94, retains seat valve selector axially spaced above selector member 138. However, pressurizing annular space 21 (FIG. 1) to increase the pressure in annulus space 21 to pressure $P_4$ moves piston 162 to its fourth position, which in turn urges the sleeve valve selector 94 and mandrels 42, 78 axially upward thereby indexing pin 43 into a one of the upward-facing slots $\mathbf{40}_1$-$\mathbf{40}_{10}$, which are clockwise of one of the elongate downward-facing slots $\mathbf{38}_1$-$\mathbf{38}_5$. Accordingly, as shown in FIG. 2K, when pressure in the annulus space 21 is reduced, the piston 162, selector member 138, sleeve valve selector 94, and mandrels 46, 78 are allowed to move downward, the profiled surfaces of the raised portion between the slots $\mathbf{39}_1$-$\mathbf{39}_5$, $\mathbf{38}_1$-$\mathbf{38}_5$ causes the pin 43 to slip into one of the elongate slots $\mathbf{38}_1$-$\mathbf{38}_5$ so that the mandrels 46, 78 can drop downward and thereby closing the sleeve valve assembly 89. As discussed above, closing the sleeve valve assembly 89 involves moving sleeve valve 76 with its slots out of registration with port 88 as the seal 90 blocks communication between slots 80 and port 88.

The steps explained above can take place prior to or after initiating the shaped charges 17 to create perforations 18 in the formation 14 (FIG. 1). In an example, pressure in the annulus space 21 can be cycled as described above to open the ball valve assembly 198 and flow fluid from the formation 14 to the surface via the tool string 10 and tubing 22. Optionally, pressure in the annulus space 21 can be cycled as described above to open the sleeve valve assembly 89 and then fluid can be recirculated through a portion of the tool string 10, to the annulus space 21, and back to surface. Further optionally, the tool 15 can be manipulated to repeatedly open and close either the sleeve valve assembly 89 or the ball valve assembly 198, without opening the other one of the sleeve valve assembly 89 or the ball valve assembly 198. In this example, the azimuthal orientation of the selector member 138 is unchanged as it is urged axially back and forth to open/close either of the assemblies 89, 198. In the example of FIGS. 2A-2F, repeatedly cycling the external pressure between $P_4$ and $P_3$ can axially displace mandrel 78 to open and close sleeve valve assembly 89 as described above, and without opening ball valve assembly 198. Similarly, as illustrated in FIGS. 2G-2K, repeatedly cycling the external pressure between $P_4$ and $P_3$ can axially displace mandrel 194 to open and close ball valve assembly 198 as described above, and without opening sleeve valve assembly 89.

Referring back to FIG. 2A, the stop ring 214 is shown circumscribing a portion of the body 96 of the sleeve valve selector 94. A backstop 222 is formed on the inner surface of the housing 166 which prevents further upward axial movement of stop ring 214. The stop ring 214 has discussed above with its crested lower ends (FIG. 10) selectively engages a one of the upward-facing ends of the fingers 98 of the sleeve valve selector 94 or legs 114 of the ball valve selector 112 and thereby allows only a one of the sleeve valve selector 94 or ball valve selector 112 upward at a time. By limiting axial movement to a single one of the sleeve valve selector 94 or ball valve selector 112, this provides a redundant means of insuring that only one of the sleeve valve assembly 89 or ball valve assembly 198 is opened at a single time. Accordingly, in instances where silting or other like mechanical failures will occur, the single flow function of the tool 15 is accomplished. In the examples illustrated in FIGS. 2A-2K, by providing the teeth 108, 126 and by strategically locating the slots 1321-1328, ensures that the arms 142 will be aligned in operational contact with either sleeve valve selector 94 or ball valve selector 112, but not both at the same time. Moreover, in examples of operation wherein teeth 108, 126 one of the sleeve valve selector 94 or ball valve selector 112 are removed from slots 1321-1328, teeth 108, 126 from the other one of the sleeve valve selector 94 or ball valve selector 112 remain aligned in slots 1321-1328; lateral contact between the arms 98, 114 of sleeve valve selector 94 and ball valve selector 112 retain the sleeve valve selector 94 or ball valve selector 112 rotationally relative to slotted sleeve 128. When the arms 142 are in contact fingers 98, arms 142 are disposed in slots formed between adjacent legs 114 so that the legs 114 operate as a guide that retains the arms 114 in contact with fingers 98. Similarly, when the legs 114 are in urging contact with arms 142, slots between adjacent fingers 98 guide and retain the arms 142 in contact with legs 114. Optionally, slots 1321-1328 can be lengthened to rotationally secure selector member 138 to slotted sleeve 128 during the entire axial stroke of selector member 138.

Traditionally, the ability to actuate downhole tools run on drill string or tubing is very limited. Currently known methods typically use rotational movement or load of the tubing sting, axial movement or load on the string, or manipulation of pressure—these methods are often unable to operate more than one device downhole at a time. However, examples of the present disclosure include simultaneously running a packer, a circulating valve, and a formation valve. Because a packer cannot be rotated or moved after being set and while functioning, pressure manipulation is the only means of actuation left. However, if devices associated with a downhole tool having a packer that is set are pressure manipulated, there must exist some means to control the devices so that they can be opened in the mariner needed.

Figure 6:
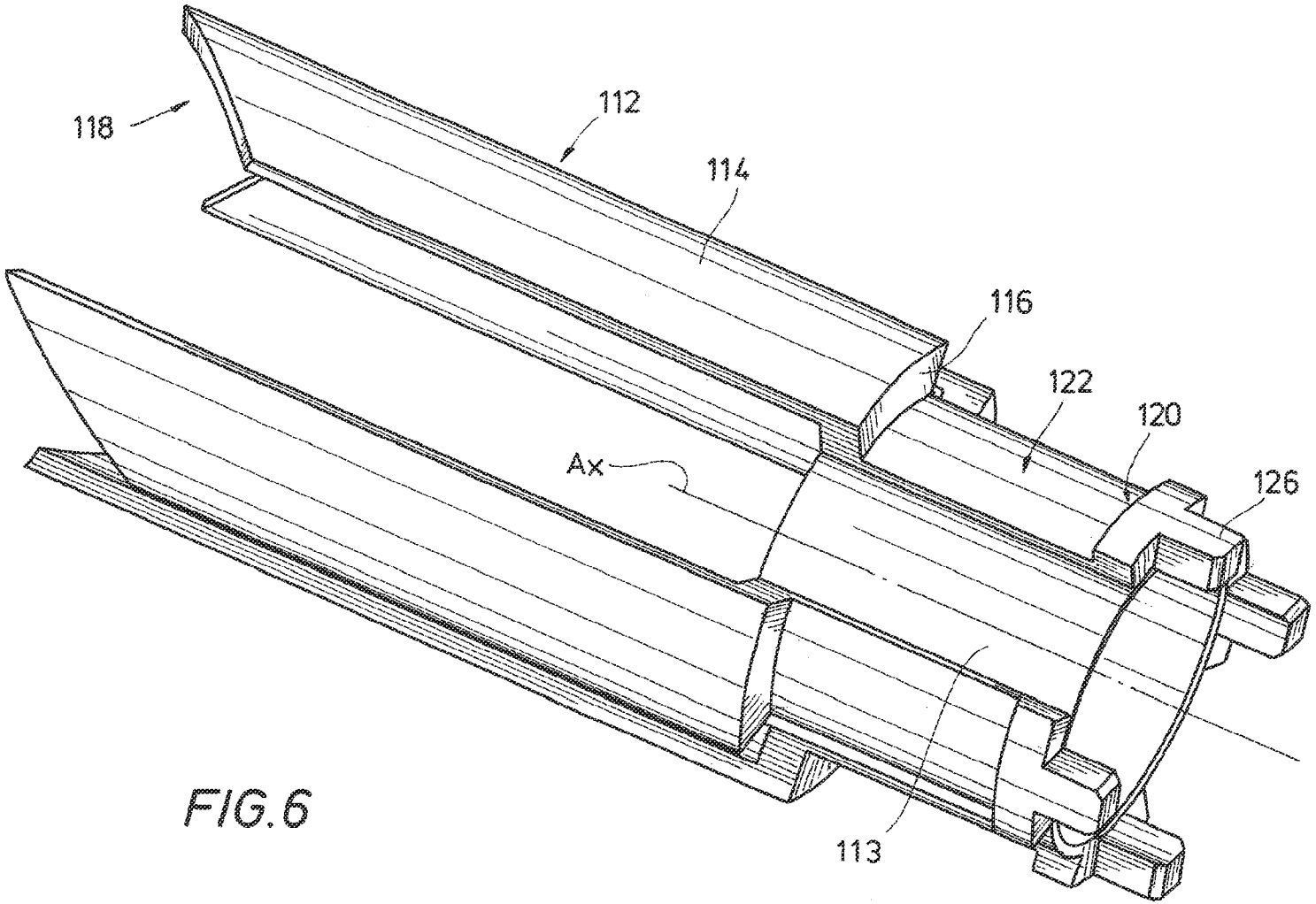
FIG. 6 is a side perspective view of an example of a ball valve selector, which is part of a selector assembly on the tool of FIG. 1 and which is in accordance with the present invention.

Moreover, when sleeve valve assembly 89 is put into an open position, upper ends of arms 142 contacts downward facing shoulders 104 (FIG. 5). Similarly, when ball valve assembly 198 is put into an open position, upper ends of arms 142 contacts downward facing shoulders 116 (FIG. 6). In contrast, when sleeve valve assembly 89 is put into a closed position, downward facing shoulders 148 (FIG. 8) contact retention shoulders 102 (FIG. 5); and when ball valve assembly 198 is put into a closed position, downward facing shoulders 148 (FIG. 8) contact downward upward facing shoulders 120 (FIG. 6). The compressed gas charge (as from the nitrogen charge) in tool 15 (FIG. 2A) can axially urge piston 162 and selector member 138 (via its connection with piston 162) downward when pressure external to the tool 15 is removed, or is returned to a first pressure $P_1$. Which depending on the angular orientation of the selector member 138; can close a one of the sleeve valve assembly 89 or ball valve assembly 198. Optionally, sleeve valve assembly 89 can be closed when upper spring 48 expands from its compressed configuration and urges mandrel 78 away from sub 32. Further optionally, ball valve assembly 198 can be closed when lower spring 172 expands from its compressed configuration and urges mandrel 194 away from connector 202. Another advantage of the downward facing shoulder 148 is that when selector member 138 moves axially in a direction away from sub 32, interference between downward facing shoulder 148 and shoulders 102, 120 interfere with selector member 138 when a one of the valve assemblies 89, 198 is in the open position. This prevents selector member 138 from moving far enough downward so that pin 146 contacts castellated profile $\mathbf{134_1}$-$\mathbf{134_8}$, or slots $\mathbf{134_1}$-$\mathbf{134_8}$. As such, the azimuthal orientation of selector member 138 cannot change when either of the valve assemblies 89, 198 is in the open position, thus any axial movement of selector member 138 towards sub 32 cannot open a valve assembly 89, 198 if the other one of the valve assemblies 89, 198 is in the open position.

Drill Stem Testing (DST), sometimes known as "tester valves", are often used in exploratory wells after drilling when the reservoir engineer needs to run tests to determine characteristics of the formation. The tests can include sampling the formation fluid for chemical content, measuring sand production, as well as formation pressure build up tests. Usually during such tests, the well is shut in, pressure is allowed to build up, and then flowed. Data from the test results can then be used to estimate the permeability and physical size of the reservoir. The DST string, therefore, needs to have a formation valve to control flow from the formation; and also requires a circulating valve so that mud weight can be changed and fluid in the tubing above the ball can be controlled. In one example, if the well flows back nothing but gas, when the ball is shut in the tubing above the ball will be gas. This is a safety risk; the gas must be flared off and replaced with mud. Another application of DST is in perforating non exploratory wells. After perforating, it may be desirable to control the flow from the well to prevent formation damage, control the well, or to result in a more productive finished well. DST valves can be used to control flow from the well.

It should be pointed out that embodiments exist for the indexing assemblies 36, 178 wherein any number of cycles or strokes on their associated mandrels 46, 180 orient the assemblies 36, 178 to actuate an associated device. Further, the assemblies 36, 178 are not limited to use with the disclosed valve assemblies 89, 198, but instead the assemblies can be used for actuating any downhole device. Accordingly, any changes in functionality of the device can take place with changes in the indexing assemblies 36, 178 rather than with the shifter assembly 92. An advantage of this is that if one of the valve assemblies 89, 198 more positions than simply open and closed, such as partially open, design of the specific indexing assembly 36, 178 can address putting the particular valve assembly 89, 198 in those positions rather than the shifter assembly 92.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, different numbers of pins can be used for alignment with the slots, and instead of pins for alignment with the slots, ball bearings, and other devices can be used to position the arms with the slots, Also, stimulus for moving the selector member 138, in addition to pressure changes, can be axial movement of the tubing 22 as well as a rotation or torque in the tubing 22. These and other similar modifications will readily suggest themselves to those skilled in the art, and are intended to be encompassed within the spirit of the present invention disclosed herein and the scope of the appended claims.

What is claimed is:

1. A downhole tool for use in a wellbore comprising:

a housing;

a packer on an outer surface of the housing that selectively extends radially outward into sealing contact with a wall of the wellbore to define a formation space below the packer and an annulus space above the packer;

an annulus valve mandrel in the housing;

an annulus valve coupled to the annulus valve mandrel and in an open configuration by moving the annulus valve mandrel to an opened position and in a closed configuration by moving the annulus valve mandrel to a closed position;

a formation valve mandrel in the housing;

a formation valve coupled to the formation valve mandrel and in an open configuration by moving the formation valve mandrel to an opened position and in a closed configuration by moving the formation valve mandrel to a closed position;

a piston axially moveable to different positions in the housing in response to a pressure ambient to an outer surface of the housing;

a shifter assembly in the housing that is rotatable and axially moveable with movement of the piston, and selectively and exclusively coupled with one of the formation valve mandrel or the annulus valve mandrel to selectively and exclusively open one of the formation valve or the annulus valve.

2. The tool of claim 1, wherein the piston is selectively moveable between a first, second, third, and fourth position.

3. The tool of claim 1, wherein by moving the formation valve in the open position, an inner space in the housing is in communication with the formation space.

4. The tool of claim 1, wherein by moving the annulus valve in the open position, an inner space in the housing is in communication with the annulus space.

5. The tool of claim 1, wherein the shifter assembly comprises;

a selector member with an annular base mechanically coupled with the piston, and elongate arms that project axially from the base and are angular spaced away from one another about an axis of the tool, an annular slotted sleeve with downward facing axial slots on an outer surface of the slotted sleeve spaced angular apart about an axis of the slotted sleeve, and upward facing axial slots on an outer surface of the slotted sleeve spaced angular apart about an axis of the slotted sleeve, and wherein the upward and downward axial slots are connected by slots that extend between the upward and downward axial slots and define a path that circumscribes the slotted sleeve, and adjacent upward and downward slots are angularly offset from one another, a pin through one of the elongate arms that projects into the slots, so that when the piston is moved in opposing axial directions, the pin is directed from a one of the axial slots into an adjacent axial slot to rotate the selector member into selective engagement with one of the annulus valve mandrel or formation valve mandrel.

6. The tool of claim 5, further comprising, a formation valve selector that comprises, an annular collar coupled to the formation valve mandrel, and shoulders that project radially outward from the collar that are angularly spaced away from one another, and that are selectively in contact with the arms by rotating the selector member into a designated angular orientation, an annulus valve selector that comprises, an annular collar coupled to the formation valve mandrel, and shoulders that project radially outward from the collar that are angularly spaced away from one another, and that are selectively in contact with the arms by rotating the selector member into a designated angular orientation.

7. The tool of claim 6, further comprising fingers mounted to the formation valve selector collar that project axially into a one of the axial slots for rotationally coupling together the formation valve selector with the slotted sleeve, and fingers mounted to the annulus valve selector collar that project axially into another one of the axial slots for rotationally coupling together the annulus valve selector with the slotted sleeve.

8. The tool of claim 6, wherein the formation valve selector and annulus valve selector are arranged coaxially, and wherein the shoulders on the formation valve selector are co-planar with the shoulders on the annulus valve selector by closing both the annulus valve and formation valve.

9. The tool of claim 8, wherein the formation valve selector and annulus valve selector both include legs that extend axially from the shoulders and in a direction away from the piston, the tool further comprising a stop ring member having an annular base ring with elongate legs that extend axially away from the base ring to form axial slots, wherein the axial slots are dimensioned to allow only a single one of the legs of the formation valve selector or the annulus valve selector, so that only a one of the formation valve or annulus valve is opened at a time.

10. The tool of claim 8, wherein the shoulders on the formation valve selector are spaced axially away from the shoulders on the annulus valve selector by opening a one of the formation valve or the annulus valve.

11. The tool of claim 1, further comprising an annulus valve indexing assembly coupled with the annulus valve mandrel that comprises an indexing collar having a continuous curved outer surface, axial slots on the outer surface that are spaced apart at different angles with respect to an axis of the tool, circumferential slots that connect the axial slots and form a slotted path that circumscribes the outer surface, and a pin coupled with the housing and that extends into the slotted path so that axial back and forth movement of the annulus valve mandrel causes the pin to move into adjacent axial slots and thereby rotate the mandrel, and wherein a one of the axial slots is formed so that when the pin the one of the axial slots, the annulus valve mandrel moves the annulus valve into the open configuration.

12. The tool of claim 1, further comprising a formation valve indexing assembly coupled with the formation valve mandrel that comprises an indexing collar having a continuous curved outer surface, axial slots on the outer surface that are spaced apart at different angles with respect to an axis of the tool, circumferential slots that connect the axial slots and form a slotted path that circumscribes the outer surface, and a pin coupled with the housing and that extends into the slotted path so that axial back and forth movement of the formation valve mandrel causes the pin to move into adjacent axial slots and thereby rotate the mandrel, and wherein a one of the axial slots is formed so that when the pin the one of the axial slots, the formation valve mandrel moves the formation valve into the open configuration.

13. A downhole tool for use in a wellbore comprising:

a housing;

an upper end in fluid communication with the Earth's surface;

a lower end in fluid communication with fluid from a subterranean formation intersected by the wellbore;

an annulus valve that is selectively opened and closed and that has a side in fluid communication with a space inside the housing and a side in fluid communication with an annular space between the housing and a wall of the wellbore;

a formation valve having a side in communication with fluid from the subterranean formation and a side in fluid communication with the space inside the housing;

a pressure actuated selector assembly connected to the annulus valve and the formation valve and that is selectively moved to a recirculating position that actuates the annulus valve into an open configuration while maintaining the formation valve in a closed configuration, and that is selectively moved to a venting position that actuates the formation valve into an open configuration while maintaining the annulus valve in a closed configuration.

14. The tool of claim 13, further comprising a piston in pressure communication with an ambient space adjacent an outer surface of the housing.

15. The tool of claim 14, further comprising an annulus valve mandrel connecting the annulus valve with the selector assembly, and a formation valve mandrel connecting the formation valve with the selector assembly.

16. The tool of claim 15, wherein the selector assembly further comprises a selector member that selectively rotates into interfering contact with an annulus valve selector that is mounted on the annulus valve mandrel, wherein the selector member comprises a collar with elongate arms spaced at angular locations on the collar and projecting axially away from the collar.

17. The tool of claim 16, wherein the annulus valve selector comprises an annular body with shoulders that project radially outward from the body and which are contacted by ends of the arms opposite the collar by rotating the selector member into interfering contact with the annulus valve selector.

18. The tool of claim 16, wherein the formation valve selector comprises an annular body with shoulders that project radially outward from the body and which are contacted by ends of the arms opposite the collar by rotating the selector member into interfering contact with the formation valve selector.

19. The tool of claim 16, wherein the selector assembly further comprises an annular shifter assembly slotted sleeve having an outer surface with slots formed thereon that extend axially and are angularly spaced apart and that are connected by slots that extend along a circumference of the outer surface, wherein the axial and circumferential slots define a slotted path that circumscribes the outer surface.

20. The tool of claim 19, wherein the selector member circumscribes the outer surface, and wherein a pin extends through a sidewall of one of the arms of the selector member and into the slotted path.

21. The tool of claim 15, wherein the selector assembly further comprises a selector member that selectively rotates into interfering contact with a formation valve selector that is mounted on the formation valve mandrel, wherein the selector member comprises a collar with elongate arms spaced at angular locations on the collar and projecting axially away from the collar.

22. The tool of claim 15, further comprising an indexing assembly on the annulus valve mandrel that comprises slots formed axially on an outer surface of the annulus valve mandrel that are angularly spaced apart and that are connected by slots that extend along a circumference of the outer surface, wherein the axial and circumferential slots define a slotted path that circumscribes the outer surface.

23. The tool of claim 15, further comprising an indexing assembly on the formation valve mandrel that comprises slots formed axially on an outer surface of the formation valve mandrel that are angularly spaced apart and that are connected by slots that extend along a circumference of the outer surface, wherein the axial and circumferential slots define a slotted path that circumscribes the outer surface.

24. A downhole tool for use in a wellbore comprising:

a housing;

a packer on an outer surface of the housing that defines a formation space below the packer that is in pressure communication with a formation penetrated by the wellbore, and that defines an annulus space above the packer that is in fluid communication with a wellhead assembly at an opening of the wellbore;

a formation valve for selectively providing pressure communication between the formation space and to within the housing;

an annulus valve for selectively providing pressure communication between the annulus space and to within the housing; and a means that is coupled to both the formation valve and annulus valve and that is for selectively opening one of the formation valve or annulus valve while maintaining the other one of the formation valve or annulus valve closed so that the formation space is isolated from the annulus space.

* * * * *